US006059521A

United States Patent [19]

Rapeli

[11] Patent Number: 6,059,521

[45] Date of Patent: May 9, 2000

[54] TRANSPORT AND DISTRIBUTION OF SHIP-BORNE GOODS UNITS

[76] Inventor: Pekka E. Rapeli, Martinlaaksontie 42 D 16, Fin-01620 Vantaa, Finland

[21] Appl. No.: 08/875,002

[22] PCT Filed: Dec. 20, 1995

[86] PCT No.: PCT/FI95/00690

§ 371 Date: Aug. 28, 1997

§ 102(e) Date: Aug. 28, 1997

[87] PCT Pub. No.: WO96/19378

PCT Pub. Date: Jun. 27, 1996

[30] Foreign Application Priority Data

Dec. 21, 1994 [FI] Finland ..... 945992

[51] Int. Cl.[7] ..... B63B 27/00

[52] U.S. Cl. ..... 414/803; 414/143.2; 414/142.1

[58] Field of Search ..... 414/803, 137.1, 414/139.4, 143.2, 142.1, 679; 114/72, 73, 77 R; 198/435; 108/51.1, 53.1, 53.3, 55.1; 206/504, 505; 220/1.5, 23.2, 23.4, 23.6

[56] References Cited

U.S. PATENT DOCUMENTS

| | | | |
|---|---|---|---|
| 2,457,841 | 1/1949 | Smith et al. | 220/1.5 |
| 3,083,670 | 4/1963 | Harlander et al. | 220/23.2 |
| 3,519,147 | 7/1970 | Walda | 414/143.2 |
| 4,498,584 | 2/1985 | Newbury | 414/143.2 |
| 4,610,594 | 9/1986 | Lane | 414/143.2 |
| 4,666,356 | 5/1987 | Newbury | 414/143.2 |
| 4,672,553 | 6/1987 | Goldberg | 414/143.2 |
| 5,131,502 | 7/1992 | Sermi | 414/143.2 |

FOREIGN PATENT DOCUMENTS

| | | | |
|---|---|---|---|
| 2126711 | 12/1972 | Germany . | |
| 2316052 | 10/1973 | Germany . | |
| 3103581C3 | 9/1982 | Germany . | |
| 61-143289 | 6/1986 | Japan | 414/143.2 |
| 62-8890 | 1/1987 | Japan | 414/143.2 |
| 3-138219 | 6/1991 | Japan | 414/143.2 |
| 176208 | 11/1994 | Norway . | |
| WO 90/08690 | 8/1990 | WIPO . | |
| WO 95/24336 | 9/1995 | WIPO . | |

*Primary Examiner*—Douglas Hess
*Attorney, Agent, or Firm*—Klarquist Sparkman Campbell Leigh & Whinston, LLP

[57] ABSTRACT

A distribution method is for transporting goods from a loading port for a ship or some other collection site, such as a storage room or centralized handling plant, to cabins or other operation sites on a ship. The steps include placing the goods on a transport pallet at the collection site; moving the transport pallet, including the goods, by an internal vertical conveyor belt on the ship to the cabins or operation sites. The method also includes performing the steps in the reverse order to transport the goods from the operation sites to the collection site.

24 Claims, 17 Drawing Sheets

K8
K7
K6
K5
K4
K3
K2
K1
K0
8
2
2
2
5
IV
IV
6
10
41
8
5
1
4d
4b
4d
6
III
III
5
4b
4d
10

TRANSPORT AND DISTRIBUTION OF SHIP-BORNE GOODS UNITS

FIELD OF THE INVENTION

The present invention relates to a distribution method in passenger vessels, car ferries and corresponding vessels, comprising a number of passenger cabins as well as at least one vertical conveyor able to transport goods to cabin floors, in order to facilitate the transportation of goods units to cabins or to several corresponding onboard operational sites, these operational sites located between the ship entrance or goods storeroom or collecting site for centralized goods handling. The invention also relates to the structures of transport pallets used in this distribution method, as well as conveyor arrangement for implementing the shifting phases included in this distribution method.

BACKGROUND AND SUMMARY OF THE INVENTION

Large passenger cruisers and car ferries are nowadays taking onboard as much as 2,500 passengers and even larger numbers are yet projected. People going on a cruise or voyage in most cases have a great deal of luggage, because lots of different outfits and travelling requisites are needed, or they, for other reasons, have plenty of luggage. Nowadays, the shifting of luggage onboard the ship in most cases takes places as a result of the passenger's own physical effort, i.e., by carrying. This is awkward, often even painful, for every passenger and especially for older and/or disabled persons. Alternatively, passengers can use services provided by porters, but even then, the shifting of luggage results from physical labor. In the previous case, the service level to the passenger is nonexistent, and in the latter case, a very remarkable number of porters are needed for a short period of time. During the voyage, there is a need for change of linen in the cabins, which further requires essentially shifting equipment and personnel to collect the used linen and to distribute the clean linen so that these operations can be carried out without disturbing the passengers in a short time period and, possibly, at desired times. During the voyage, it is also necessary to shift goods from storerooms to galleys, shops, and kiosks, and to return empty packing material to storerooms and garbage rooms. There is a further need, at least to some extent, to transport food from the galley to cabins and carry empty used dishes in the reverse direction. All this requires labor, transportation, and transporting equipment. Because the cabins, kiosks, shops and other corresponding sites onboard the ship are mostly situated on different decks than the storerooms, ship entries and cargo ports, galley and centralized preparation/processing plants, like laundries and other collecting sites, a vertical conveyor, mostly a lift, will be used for vertical transportation.

In airports there are various automated conveyor systems for the handling of luggage flows. The handling of material between the check-in point and the loading cart is carried out by these systems in a very mechanized way. The most sophisticated systems also use a code relating to a goods unit in order to express the connection between the goods unit and its owner at the end of the trip. The essence here is that the handling of the luggage takes place as an individual from the check-in to the cargo bay of the plane. The luggage handling of smaller planes is very labor intensive. At the distribution crates of the transportation system, luggage goods are manually placed in transportation carts accommodating from 15 to 20 suitcases. A tractor will pull a train of 5 to 10 carts to the plane's cargo openings and, after that, the loading of the plane will take place by manual lifting and human pushing inside the plane. In the new wide-bodied planes, the luggage is placed in freight containers, again, suitcase by suitcase manually. The transverse section of the containers matches broadly the curved form of the fuselage and the containers are loaded by articulated elevator into the plane. Within the plane, the containers are shifted by means of a train of rollers and power wheels or conveyor chains of known technology. The goods can also be supplied one by one into the plane's cargo bay by using a shift conveyor and within the plane the goods units are handled by manual piling and lashing. The luggage of an arriving airplane, without regard to the model/make of the plane, will be unloaded manually onto a conveyor belt, by which the suitcases are transported to a lounge for identification of their owners. A fast cargo unloading and loading of a large airplane is a very big challenge to the system, although such large airplanes only take about 350 persons onboard, which is a small number of persons as compared to those of a passenger vessel or a car ferry. The sorting stages in the terminal, as well as transporting stages to the airplane, loading methods, and cargo handling within the airplane, are quite rudimentary. They also differ from that handling of luggage and other material to be brought to cabins and to many operating sites, which would be required in passenger cruisers and car ferries. It is necessary to transport the luggage from the terminal, not only into the cargo space, but also into numerous cabins onboard the ship. Further, during the trip, especially during a long cruise, linen needs to be collected and transported from cabins to the laundry and again distributed back to cabins, and further, various merchandise must be shifted from the storerooms to sales offices, stores, or vending machines, to transport food and servings from the storerooms to the galleys, and further, from the galleys to the cabins, as well as to transport empty and used dishes and the like from the cabins and vendor machines back to galleys and storerooms. In known arrangements, all these movements and transports are mainly carried out manually and in very small batches.

In the application PCT/NO90/0007, there is a description about an arrangement intended for shifting of cargo units from a warehouse on a quay to cargo spaces onboard the ship by using conveyors. This arrangement comprises, within the ship, two adjacent cargo lifts and an inclined conveyor fixed to the ship as well as to the quay. It can be used for shifting of cargo units from the quay to the side cargo port and by this route to the cargo lift. The arrangement contains a conveyor leading from the warehouse on the quay towards the ship's side, between the conveyor and side there are two operating means of transportation, parallel to the ship's direction, on top of them separate conveyors operating towards the ship's side, in the inclined conveyor, there is a conveyor operating perpendicularly to the ship's side, on the lift platforms, conveyors operate perpendicularly to the ship's side, and further, in the hold, there are conveyors operating perpendicularly to ship's side. When in operation, this conveyor arrangement takes, from a warehouse on the ground, goods or batches of goods corresponding to the size of the lift platform, which moves as is, without relocation onto pallet or the like, riding on various conveyors until it ends up to ship's hold. The essence in the publication is the said inclined conveyor, which is intended to prevent the ship motions from disturbing the goods shifting between the ship and the quay. The loading of the ship's cargo hold may effectively be automated, supposing that freight units are big enough to be handled in a controlled way with these conveyors of undefined types. The arrangement described in this publication does not in any way allow shifting of the luggage, which are small, and vary considerably in shape and foot support and even sometimes are obscure. Neither is it possible with the conveyor in compliance with the publication to transport linen, dishes and equipment, nor foodstuff packages or prepared meals. The stowage of the ship's hold can be carried out with the described arrangement, but that will not give any hint of how the distribution of small, separate goods or goods batches into ship's cabins or the collection of the same from the cabins could be arranged in such a way that, if need be, the relation between the goods and the respective cabin is under control all the time.

The first aim of the invention is a remarkable enhancement of the customer service in passenger ships and car ferries by creating a distribution method in which the passenger luggage can be moved from the passenger terminal, or from the ship entrance, onboard the ship with the aid of a technical system and, further, if need be, moved directly into cabins or corresponding operation sites, and when used in an opposite direction, will enable the collection of passenger luggage from the cabins and with the aid of the technical system, moving it to the terminal or other collection site, so that there is no need for passengers or other persons to move separate luggage items. The aim is to speed up the loading and, respectively, the unloading stages, which means that the system enables a short delivery cycle for all ship-borne luggage.

The second aim of the invention is to create such a distribution method, so that by using it underway, goods units needed in cabins or otherwise in many corresponding operation sites like vendor machines, kiosks, and stores, can be transported from a centralized handling site, like a storeroom, galley, laundry, or corresponding collection site. Likewise, it is possible to transport used goods units from these operation sites back to the centralized handling plants, like storerooms, galleys, laundries or the like.

The third aim of the invention is such a distribution method, where the required equipment is taking as little as possible space within the ship both during its operation and, especially, when it is not in use.

The fourth aim of the invention is such a distribution method, in which the used equipment and tools are also simple and reliable in marine use.

The fifth aim of the invention is to create a special pallet, or the like, to be used in the distribution method in accordance with the invention, said pallet being suitable to accommodate relatively small, separate goods units and likewise being suitable to be transported by mechanical conveyors of various loads. The aim is to create a pallet by which goods units in smaller or larger batches can be transported, and is structurally simple, and if necessary, enables loading of goods units to several vertical levels and transportation of them in that form.

The sixth aim of the invention is such a pallet, that is structurally simple and its storage, when not in use, requires as little space as possible.

The seventh aim of the invention is to create such a conveyor arrangement at least to some location or locations in the distribution channel, which enables the realization of the distribution method according to the invention and the use of pallets according to the invention, so that goods units can easily be shifted to desired directions when space within the ship is used as little as possible.

The drawbacks described in the foregoing can be corrected, and the objectives defined in the foregoing can be realized, by the distribution method according to the invention, which is characterized in what is presented in the characteristic features part of claim 1 and by the transport pallet structure according to the invention, which is characterized in what is defined in the characteristic features part of claim 16, as well as by the transporting arrangement, which is characterized in what is defined in the characteristic features part of claim 22.

One of the most significant advantages of the invention is that, by using it, the luggage can be shifted fast, without physical labor from the passenger terminal to the cabins onboard the ship vice versa, whereupon the service level to the passengers is improved and the shifting of the luggage does not prolong the ship's harbor calling time. Another advantage of the invention is that the same arrangement can also be used for shifting of linen and food between the laundry and the cabins, and respectively, between the galley and the cabins, as well as for shifting of supplies for stores and kiosks, and potential vendor machines to sales locations, and, further, for shifting of potential empty cartons, bottles, and the like, back to storerooms or handling sites. A further advantage of the invention is that the equipment provided by the invention does not require appreciable space within the ship, is of simple structure, and is reliable and seaworthy.

The invention is described below in detail, referring to the accompanying drawings.

DESCRIPTION OF THE PREFERRED EMBODIMENTS

Figure 1:
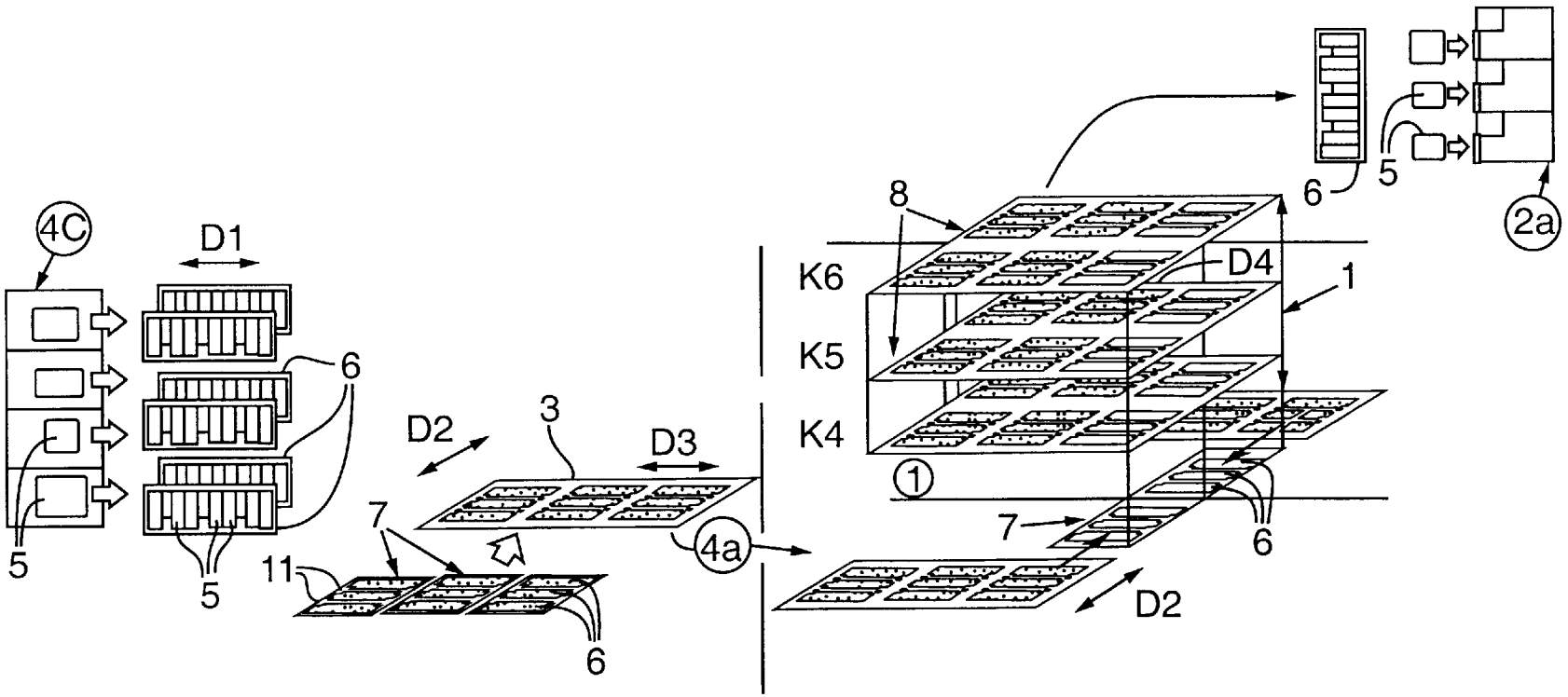
FIG. 1 illustrates the distribution method according to the invention and transportation directions schematically between the passenger terminal and the ship, as well as within the ship.

The invention relates to a distribution method for removing separate goods units from a cluster of goods units and moving them to locations where they are needed, as well as the reversed realization of the same, e.g., a collection method where separate goods units are collected from where they are used and gathered to a larger cluster for some handling, storage, and so forth. The distribution method of the invention also includes the combination of the above-mentioned practice, where separate goods units are gathered into a larger cluster on the same area, transported in substantial batches to another area, removed from the cluster, and put where they are used, or moved to the collection sites. The invention relates to passenger ships, car ferries and similar vessels containing a number of passenger cabins 2*a* as well as other operation sites 2, such as stores and kiosks 2*b* and vendor machines and the like. These operation sites are generally marked with an index number 2 and they refer to locations where the luggage is needed individually or the other goods units are used individually. Goods units 5 can be considered, besides each suitcase or the like; also every beverage bottle and crate, each separate linen, or another separate item, or packing material. The goods units are generally marked with an index number 5. Further, the operational environment of the distribution method according to the invention comprises collection sites 4, where the said goods units are gathered or through which the goods units are carried centrally. Such collection sites are considered the ship entrance 4*a*, storerooms 4*b*, the centralized handling sites of the goods 4*d*, the laundry, and the galleys, as well as the ship's passenger terminal 4*c* in the harbor.

By using the distribution method of the invention, the goods units 5 are moved between the collection sites 4 and the operation sites 2 in one or in the other direction. Generally, the word distribution is used when the good units 5 are transported either from the collection site to the operation sites, or from the operation sites to the collection site, regardless of which operation sites above are in question or which collection sites above are in question. In addition to the above, the passenger ship or car ferry has at least one vertical conveyor 1, suitable for goods transportation and opening to the decks having cabins on them, K4 to K8. This vertical conveyor 1 is mostly a lift, as illustrated in the figures, but it can also be some other conveyor moving between the decks. The vertical conveyor can also be a conveyor equipped with a load platform 10, moving along an inclined course. It is essential that the course of the vertical conveyor has a vertical component. Normally this same vertical conveyor, e.g., a lift, operates alongside and between the decks K4 to K8, which have operation sites on them, also operates between decks K0 to K2 having collection sites as well as between other decks K3, as described in detail below.

In the following, the invention will be described in relation to moving luggage from the passenger terminal to the cabins and reverse, but it is clear that the same procedure can also be applied to any shifting within the ship between the ship cabin or another operation site, like store and kiosk or vendor machine as well as the collection site, like storeroom, galley, laundry or other similar site.

When the passengers arrive at the passenger terminal and present their tickets, their luggage will, according to the invention, be marked with some suitable tag providing information about the number of the passenger cabin 2*a*, as well as the ship's deck K4, K5, K6, K7 or K8, on which the cabin is located. Next, as shown in FIG. 1, the luggage 5 in collecting site 4*c* is placed onto the transport pallet 6. Here, only such luggage 5 will be placed onto each transport pallet that, according to the attached tags, belong to the same deck onboard the ship. Thus, onto each transport pallet only goods units 5, moving to the same deck K4 to K8 are placed.

Figure 4:
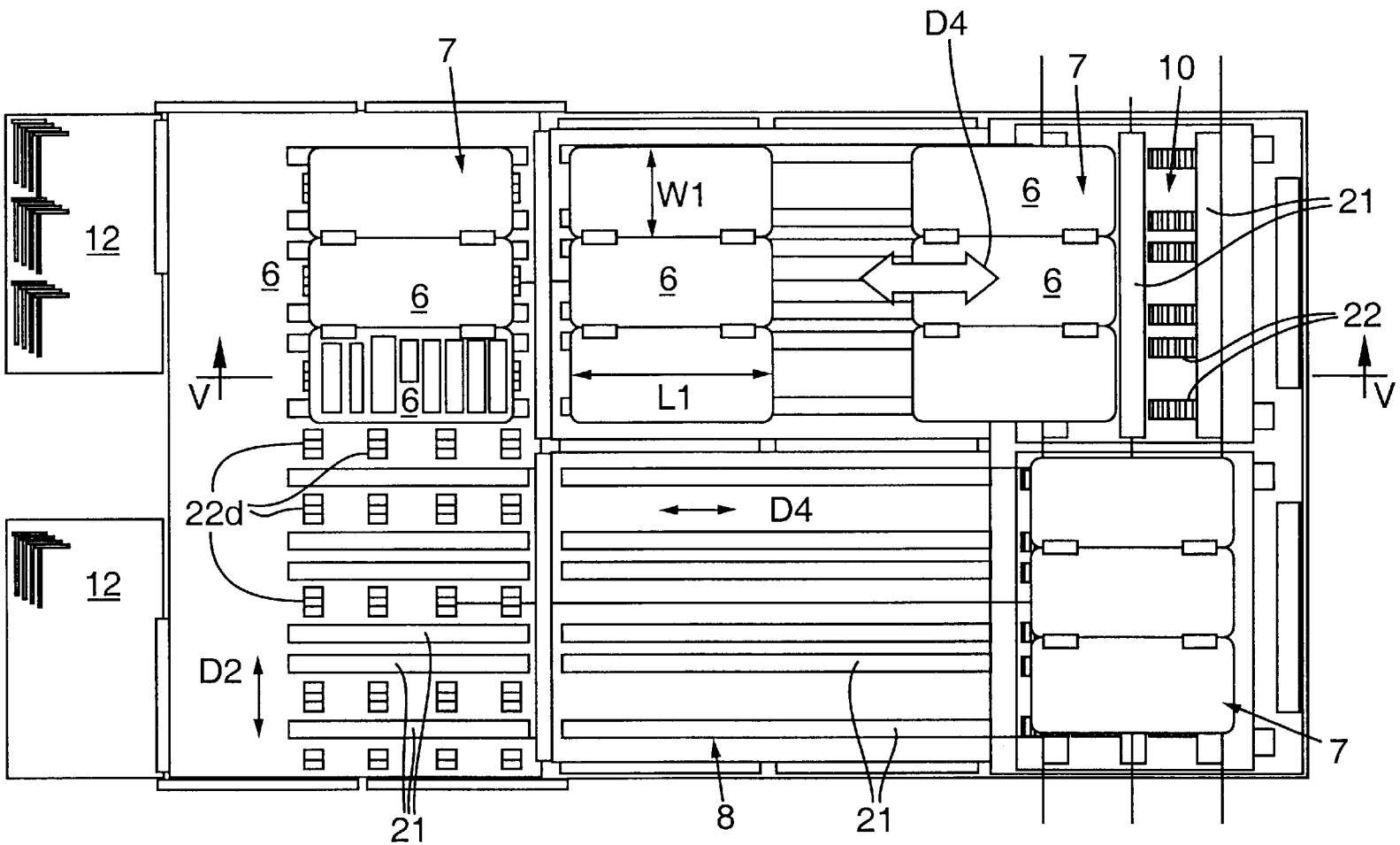
FIG. 4 illustrates, in a top view as a section along plane IV—IV of FIG. 2, a means by which the goods units, as bundles of pallets, are removed from the lift platform according to the distribution method of the invention using horizontal conveyors on the ship decks K4 to K8 containing operation sites, or on another deck K3.

Next, in an advantageous embodiment of the invention, the transport pallets 6 are clamped together 11 by their brims 118*a* (FIG. 16) to form a bundle of platforms. These bundles of platforms are created so that one bundle contains such transport pallets that have luggage belonging only to cabins on the same deck of the ship. Here, the transport pallets are specifically clamped by the brims to each other so that the pallets are side by side at the same level. Typically, the size of the transport pallet allows on an average of from 5 to 20 luggage units, like suitcases, to be placed on it. The width of the transport pallet W1, as seen in FIG. 4, is from 0.7 to 1.5 m and its length L1 is from 1.5 to 4 m, typically from 2 to 3 m. The bundles of pallets have each at least two transport pallets placed side by side, but typically from 3 to 4 transport pallets, whereupon the size of the bundle of pallets preferably matches the size of the load platform of the vertical conveyor 1. Depending on other arrangements and the size of the load platform of the vertical conveyor, the bundle of pallets can also be comprised of several transport pallets. Typically the size of the bundle of pallets will be from 1.5 to 4 m times 1.4 to 4.5 m, in the most preferred embodiment from 2.5 to 3.5 m times from 2.0 to 3.0 m. Preferably, the size of the bundle of pallets is either equal to the load platform 10 of the vertical conveyor 1, or equal to a fraction of the load platform divided by an integer (e.g., half, third, or fourth quarter, etc.) depending on the size of the load platform and on the practical size of the bundle of pallets. Decisive to the size of the bundle of the pallets is the number of goods units, such as luggage, coming on each deck of the ship so that the size of the bundle of pallets is suitable when the luggage to each deck of the ship can be brought by reasonable number of moving events, e.g., bundles of pallets. The number of moving events of the bundles of the pallets is preferably reduced to a minimum as per one vertical conveyor and ship deck but from 1 to 10 movements per ship deck and vertical conveyor is to be considered as a reasonable number. It should be borne in mind that an appropriate number of movements as well as the size of the bundle of pallets is affected by the number of the vertical conveyors and in how many tiers the goods units are placed in each bundle of pallets.

Next, according to the most preferred embodiment of the invention, the bundles of pallets are placed side by side onto the transport pallet 6. The surface area of the transport pallet is adequate to accommodate side-by-side at least two, and preferably from three to five bundles of pallets. The size of the transport platform is suitable for moving on the cargo deck of the ship having some loading opening or loading openings or entrances of the ship. The size of the transport platform is thus from 2 to 4 m times 6 to 9 m. The transport platform is further structurally self-supporting and it can be used to shifting of pallets by means of various transportation devices like trucks, lifts, or the like. On the transport platform, it is possible to place transport pallets and bundles of pallets, which are going to any one of the ship's decks. The bundles of pallets 7 are moved, riding on this transport platform, from the passenger terminal 4*c* or respectively from the quay via the loading port of the ship next to the vertical conveyor 1. This movement can be carried out by truck or by another suitable conveyor or conveyor arrangement. Next, the bundles of pallets or pallets are shifted one by one from the transportation platform onto the load platform 10 of the lift.

Next, the bundles of pallets 7 or an individual pallet 6 are lifted and/or lowered by the vertical conveyor 1 to at least cabin decks K4 to K8. After the vertical conveyor has reached the desired cabin deck level and stopped there, the bundle of pallets or transport pallet moves from the lift platform 10 to the storage space 8 next to the vertical conveyor on the deck in question. The surface area of this space is at least equal to that of one transport pallet 6 and preferably at least, equal to that of a bundles of pallets; depending on which ones are moved, either transport pallets or bundles of pallets. Provided that a bundle of pallets has been brought into this storage space 8, the transport pallets of the bundle 7 are separated from each other. In the storage space of each cabin deck K4 to K8, there always are separated transport pallets 6 having on them luggage units 5 belonging to this very deck.

Figure 14:
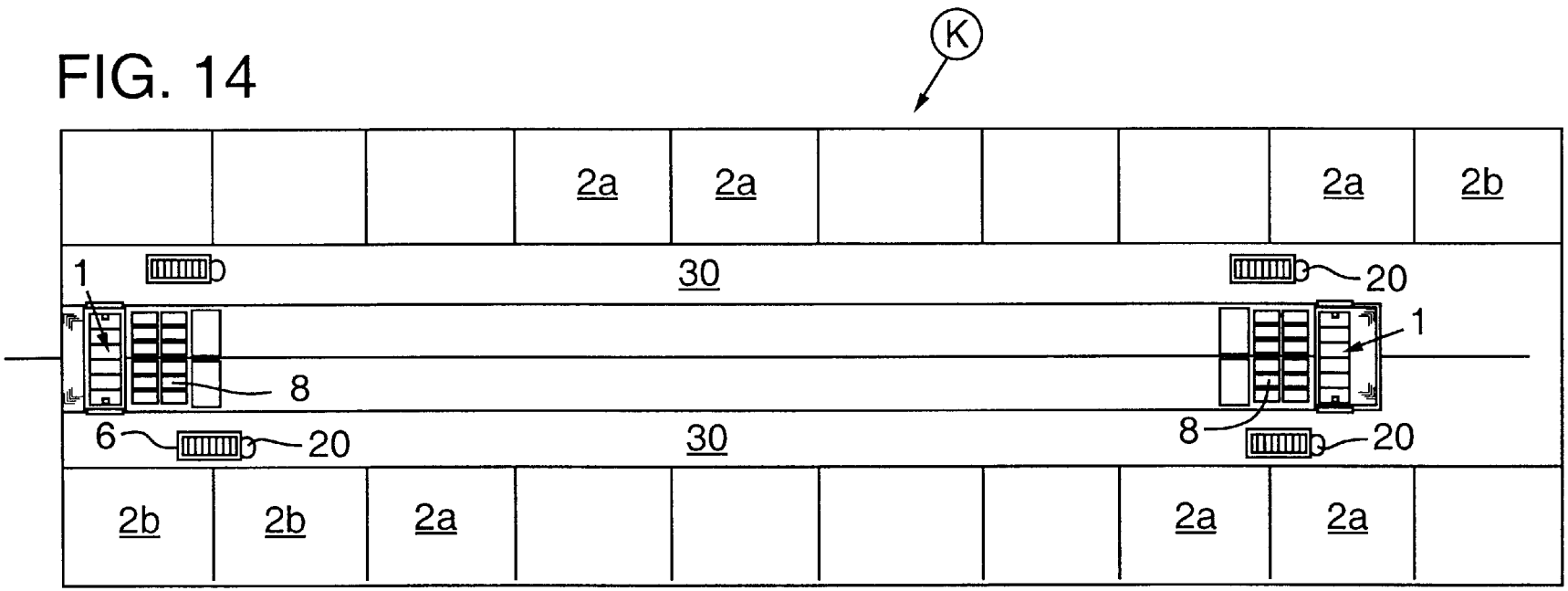
FIG. 14 illustrates the implementation of operation site distribution and collection on one of the ship's decks, which is one of K4 to K8, in top view in the same image as FIG. 13.

On the decks K4 to K8 containing operation sites, from this storage space 8 one transport pallet 6 with its luggage 5 is individually taken and transported along the corridor 30 of this deck, as illustrated in FIG. 14. When the pallet 6 is transported along the corridor 30, the luggage on the pallet in question is distributed at the same time to the cabin 2*a* to which it belongs, either inside or next to the door. In this way, the luggage is transported mechanically from the passenger terminal to the cabin.

The most preferred embodiment of the invention is described above, but various modifications can be made depending especially on the vertical conveyor and used space. For example, the clamping of the transport pallets 6 by their brims can be omitted, (i.e. unbundled) and instead be moved one by one onto the transport platform 3. The transport pallets are moved from this transport platform 3 one by one or as a group onto the load platform 10 of the vertical conveyor 1 otherwise in the same way as the bundles of pallets. The transport pallets 6 are further moved from this load platform 10 of the vertical conveyor along the ship's decks one by one or as a group otherwise exactly in the same way as the bundles of pallets.

As a third embodiment, there is a system where the transport pallets are made into bundles of pallets 7 by clamping them together by the brims and are moved directly on to the load platform 10 of the vertical conveyor 1 without help of any transport platform. In this case, the bundles of pallets are moved from the load platform of the vertical conveyor exactly as is described above.

A forth possible embodiment is to move the transport pallets 6 one by one onto the load platform of the vertical conveyor by omitting their bundling completely as well as the use of any transport platform. Such an embodiment, however, provides, at least for the luggage, a very sophisticated conveyor between the passenger terminal 4*c* and the vertical conveyor 1 in order to avoid the potential bottlenecks delaying the loading and unloading of the ship. Otherwise, the last-mentioned embodiment can be applied in many cases during the trip to the internal transports within the ship.

As a fifth modification of the distribution system described above, the cabin decks K4 to K8 use no separate powered conveyors. A mechanical distribution to the cabins is not realized, but instead the passengers take their own luggage from the transport pallet next to the vertical conveyor.

The distribution method according to the invention is also related to the operation described above but realized in a reversed direction. This kind of operation is carried out when the ship has entered port and the luggage 5 must be transported from the cabins to the passenger terminal 4*c*. In this case, the passengers place their luggage outside their cabin, from where they are collected and placed onto the transport pallet, which is placed on a transport device 20. Next, the transport pallets are moved by this transportation device to the storage space 8 of the Deck K4 to K8 in question, where they are clamped together by their brims to make a bundle of pallets 7. These bundles of pallets 7 are shifted onto the load platform 10 of the vertical conveyor 1 and are lowered to the deck K0 containing a loading port 4*a*. Here, the bundles of pallets 7 are moved onto the transport platform 3, which with the pallets is moved by a truck or equal conveyor to the passenger terminal, where the bundles of pallets 7 are removed from the transport platform and the bundled pallets are unclamped to separate transport pallets 6 loaded with luggage 5 from which the passengers can take their luggage when they are leaving. When the shifting is carried out in this direction, the passengers generally identify their own luggage, but this can be backed up either by remarking the luggage by the passenger's name and/or cabin number, or the tags containing this information can be kept attached to the luggage during the trip. If additionally, all transport pallets 6 in the passenger terminal are clearly marked by boards indicating the deck of the ship, the passengers need only to check a couple of pallets to find their own luggage.

Figure 8:
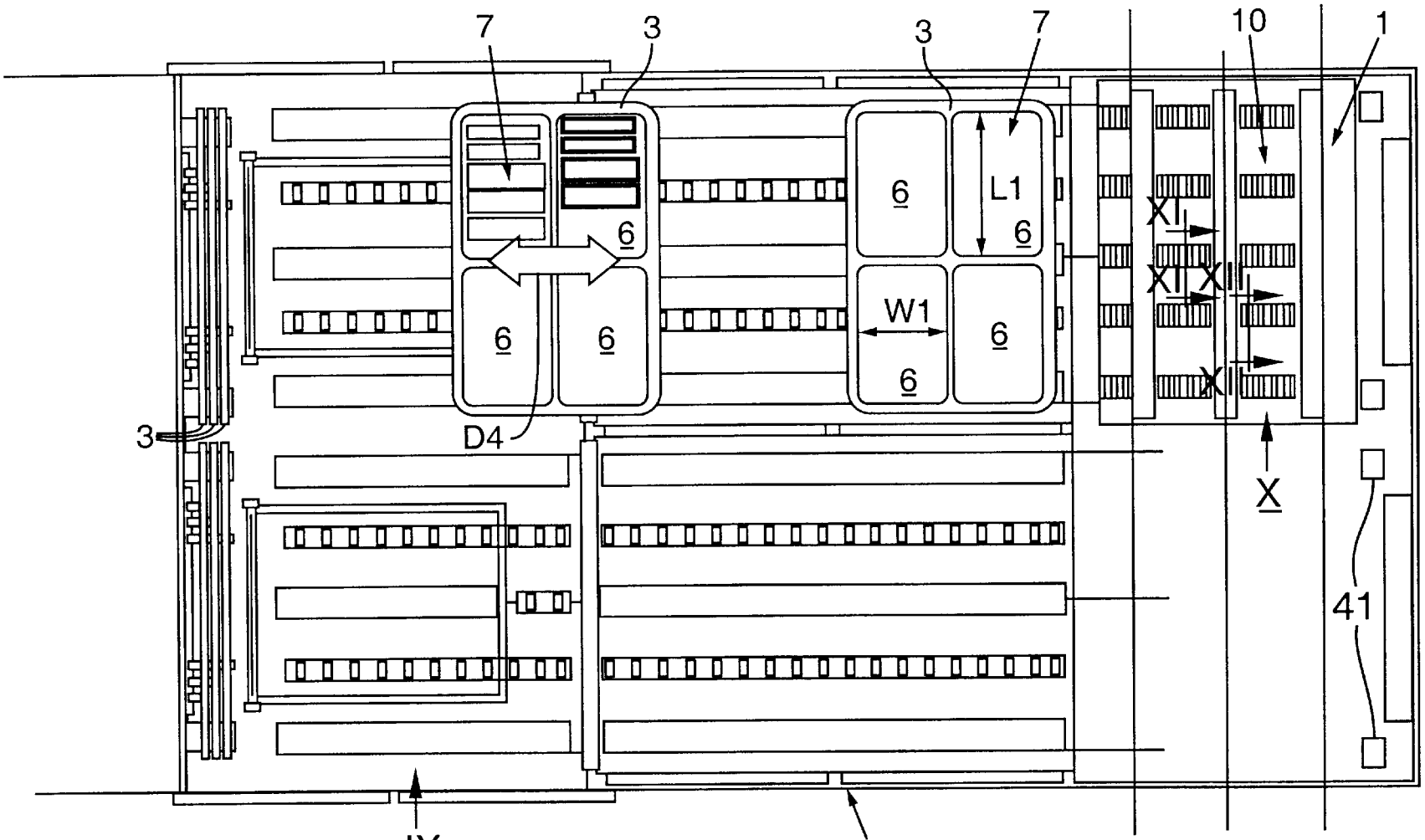
FIG. 8 illustrates another method according to the invention for removing goods units from the lift platforms, as well as another way for storing the transport pallets in top view in the same image as FIGS. 4 and 6.
Figure 9:
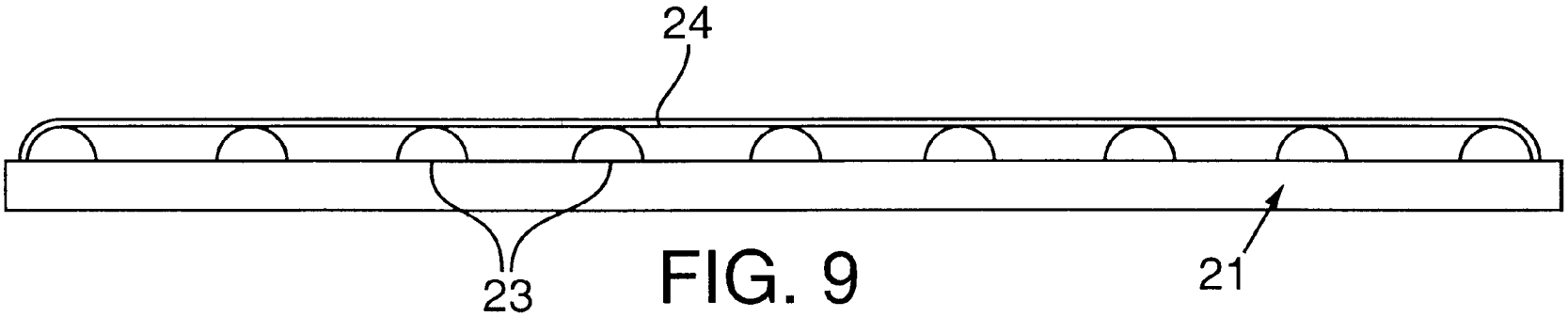
FIG. 9 illustrates schematically a belt conveyor used in the distribution method according to the invention in elevational view in direction IX—IX of FIG. 8.
Figure 10:
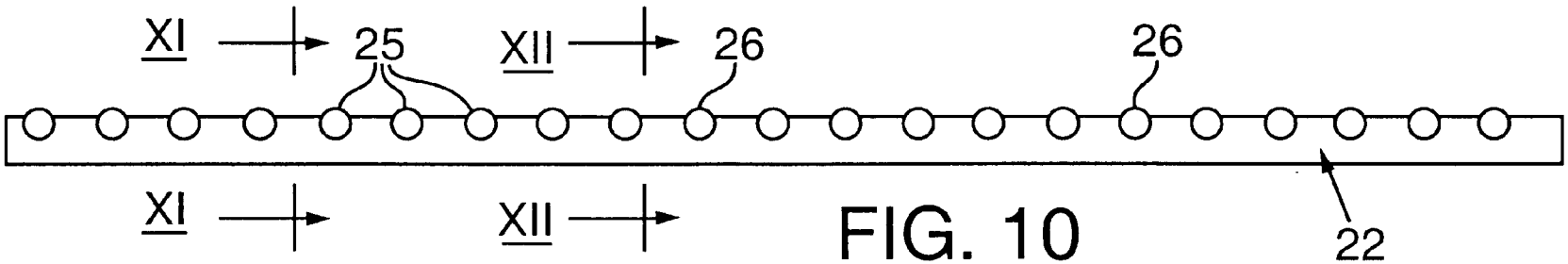
FIG. 10 illustrates another belt conveyor used in the distribution method according to the invention in elevation view in direction X—X of FIG. 8.
Figure 11:
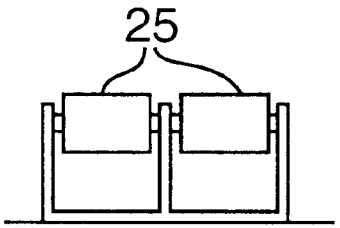
FIG. 11 illustrates a cross-section of the conveyor of FIG. 10 as a section along plane XI—XI, in which case passive rollers are described.
Figure 12:
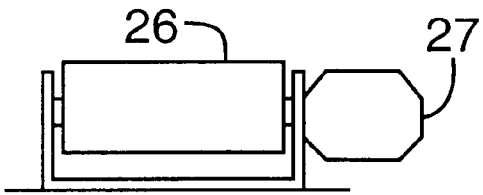
FIG. 12 illustrates a cross-section of the conveyor of FIG. 10 at another location as a section along plane XII—XII, in which case powered rollers are described.

As a sixth embodiment, there is a distribution method where the transport platform 3 acts as a platform of pallets 6 even to ship's decks containing operation sites 2, as presented in FIG. 8. In this case, the size of the transport platform matches that of the load platform 10 of the vertical conveyor 1 (i.e. it is rather small). The transportation pallets are in this case stored for the trip period, for example by hoisting them in a vertical position against the bulkhead next to the vertical conveyor, as illustrated in FIG. 8. The storage takes very little space because the small transport platforms need not be very robust.

The invention naturally relates to all simplifications of the procedures described above, which are partly described. The bundling of the transport pallets can be omitted, operated without the transport platform 3, and the mechanical delivery from possible storage spaces 8 or vertical conveyors 1 to operation sites 2 and mechanical, or physical operation stages. These kinds of physically performed stages can be considered in addition to the afore-mentioned moving from the storage space 8 next to vertical conveyor 1 to the cabins 2*a* and vice versa, also shifting onto the load platform of the vertical conveyor and from the same, as well as onto the transport platform and from the same.

The transport of the luggage from the passenger terminal to the cabins and from the cabins to the passenger terminal has been described above. When the ship calls a port, the same arrangement can also be used within the ship during the voyage. The described system will be a little bit more simplified because it is usually not necessary to bundle the transport pallets 6, but they can instead be moved one by one between the decks K0 to K8 by using the vertical conveyor 1. Neither is there nay need to use any transport platform, because the pallets are not moved out of the ship. For example, the linen can be collected during the voyage from the cabins 2*a* by using the transport pallet 6, which is moved by the transport device 20 along the corridors 30 of each cabin deck K4 to K8. For this purpose, it is naturally possible to place a set of shelves or a rack in order to make it accommodate more load. The transport pallets are then moved onto the load platform 10 of the vertical conveyor and moved to the deck K1 where the laundry 4*d* is located. Respectively, the clean linen can be transported in reverse order and in reverse direction, either from the linen storeroom or laundry 4*d* to the cabins 2*a*. Similar to what is described above, prepared foodstuffs can be transported from the galley 4*d* to deck K2 to the cabins and used dishes back from the cabins 2*a* to the galley for washing. Furthermore, it is also possible to move goods from the ship's stores 4*b* onto the transport pallets 6 and to move them onto the load platform 10 of the vertical conveyor 1 on the ship's deck K0 to K2 in question, and to move decks having operation sites like kiosks 2*b* or stores, where the transport pallets are moved via the storage space 8 by using the separate transportation device 20 further to be transported to the kiosk or store 2*b*. Garbage, such as empty bottles and packing materials from the kiosks and stores, can further be moved in reverse order by the transport pallets and vertical conveyor to the storeroom 4*b* or to waste containers.

Figure 7:
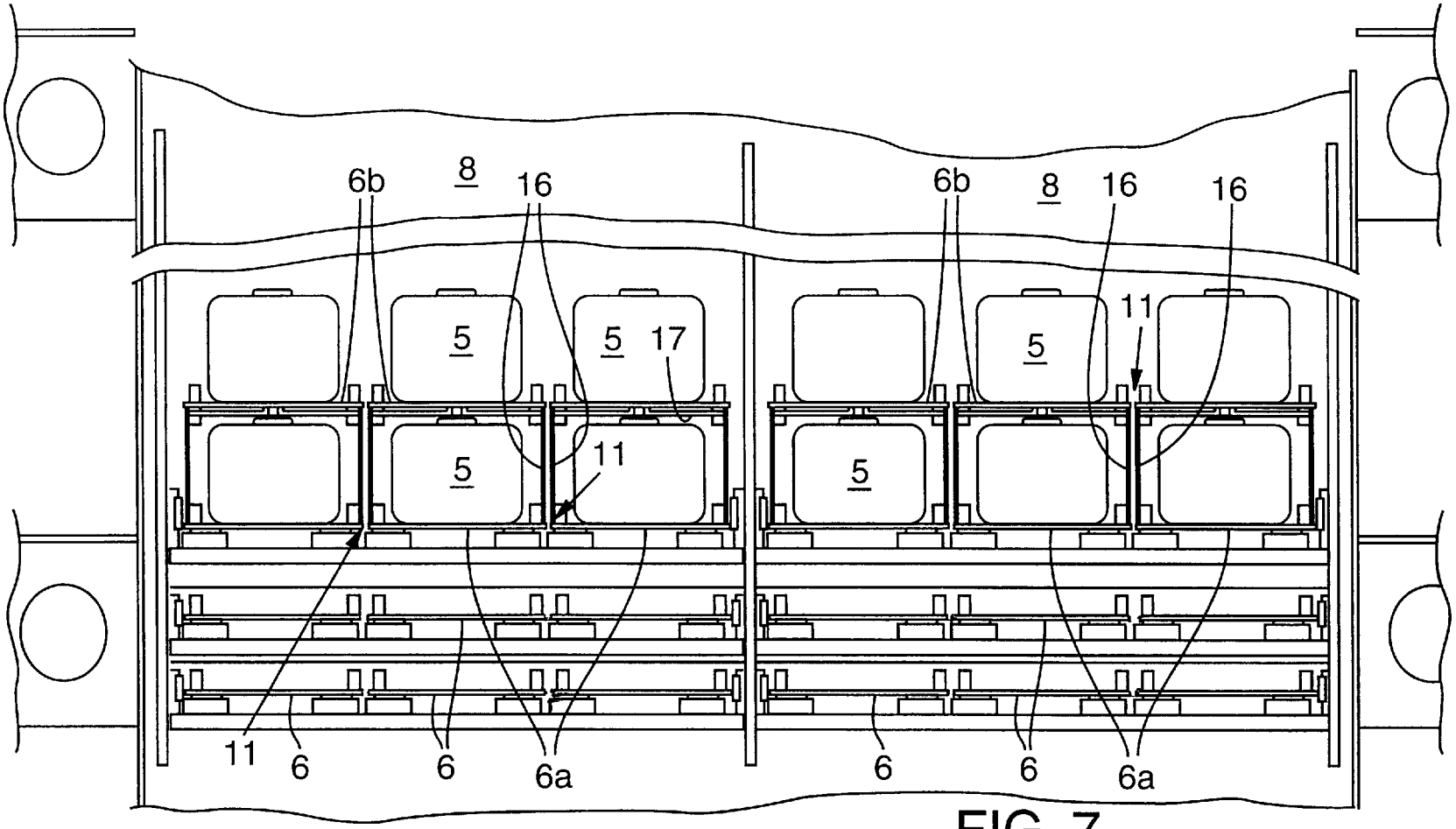
FIG. 7 illustrates a cross-section of another arrangement for removing of goods units from the lift platforms in elevational view as a section along plane VII—VII of FIG. 6, as well as storage of the transport pallets within the floors between the ship's decks during the time period they are not needed for moving goods units.

Because the distribution method according to the invention occasionally requires a substantially great number of transport pallets 6 not all of which may be needed during the voyage, the empty transport pallets can be stored on those decks K4 to K8, where the pallets with their luggage have ended up when brought and distributed there. On the deck in question, they are stored in any suitable location, as in the not-shown deck compartment in the figures or within the deck structure as shown in FIG. 7. Because the transport pallets are very thin, the storage of a couple of pallets on each deck does not take appreciable space. From this storage place, the transport pallets are easy to remove when the ship is calling a port and when collection of the luggage from the cabins is started. A couple of transport pallets 6 are stored respectively on the decks K0 to K3 having collection sites 4*a*–4*d* related to collection of used linen, empty bottles, crates, or the like from the decks containing al operation site. A pallet is taken from these stores of transport pallets, when the goods units 5 are to be transported from these decks K0–K3 to cabin decks K4–K8. The transport pallets 6 are moved on these devices K0–K3 containing a collection site 4 by using a conveyor or a powered separate transport device, not shown in the figures, between the storeroom, galley, laundry or other service or handling plant and the load platform of the vertical conveyor. The transport pallets are hoisted to their storage place either manually or as the embodiment in FIG. 7, by the vertical conveyor 1.

Figure 21:
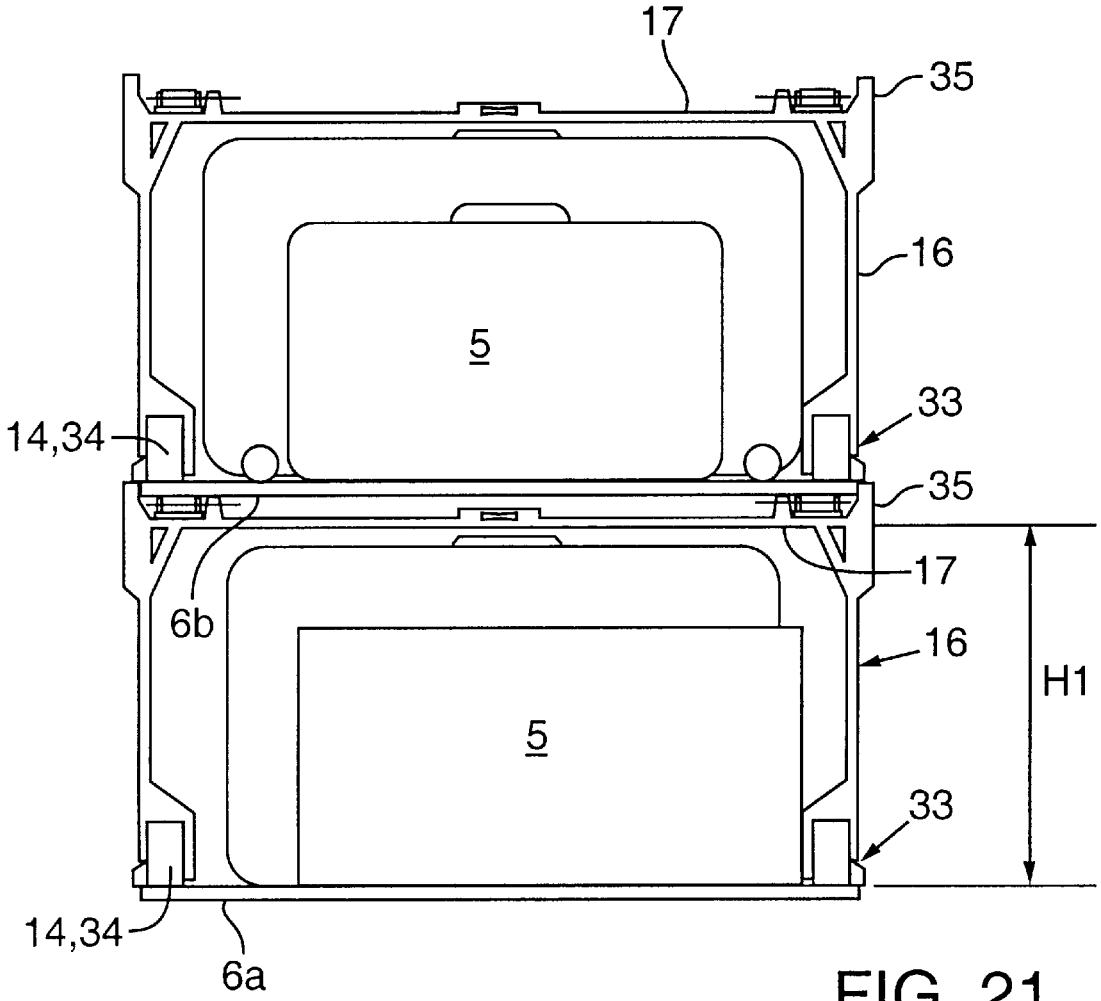
FIG. 21 illustrates a two-story transport pallet according to the invention with good units in vertical cross-section as illustrated in FIGS. 17 and 19.

Because the goods units 5, such as luggage, placed onto one transport pallet side by side according to the invention and described as above, require a relatively short span in the vertical direction, the space is utilized quite inefficiently in this arrangement. The vertical space utilization can be improved by the following procedure. In this method according to the invention, a casing 16 (FIG. 5) is also placed on top of the first loaded transport pallet 6*a*, resting on the firstly placed transport pallet 6*a* below. This casing 16 comprises an upper part 17, which is in the same direction as the first transport pallet 6*a* and at a vertical distance of H1 above it. On top of this upper part 17 is placed another transport pallet 6*b*. Goods units 5 are placed onto this second transport pallet in a similar way as was done earlier with the first transport pallet 6*a*. Thus, twice as many goods units can be arranged on a surface formed by one transport pallet having a length of L1 and a width of W1. The goods on the upper second transport pallet can be left there completely unlashed or they can be fixed by a net for the period of moving . One possibility is to place on top of this second transport pallet 6*b* further another casing in order to help the goods units to stay put. The efficient use of the footprint area can further be improved by placing a third transport pallet on top of this upper part of the second casing and onto it further goods units 5. In this way, as many transport pallets with their goods units and casings can be placed on top of each other as the vertical height of the space allows. The normal room height within the ship easily allows to place three casings 16 with four transport pallet on top of each other, whereupon the total height of the stack will be slightly over two meters. Because of simple handling, it generally is most practical to limit the use to two tiers of transportal pallets on top of each other, as illustrated in FIGS. 15 and 21.

Figure 15:
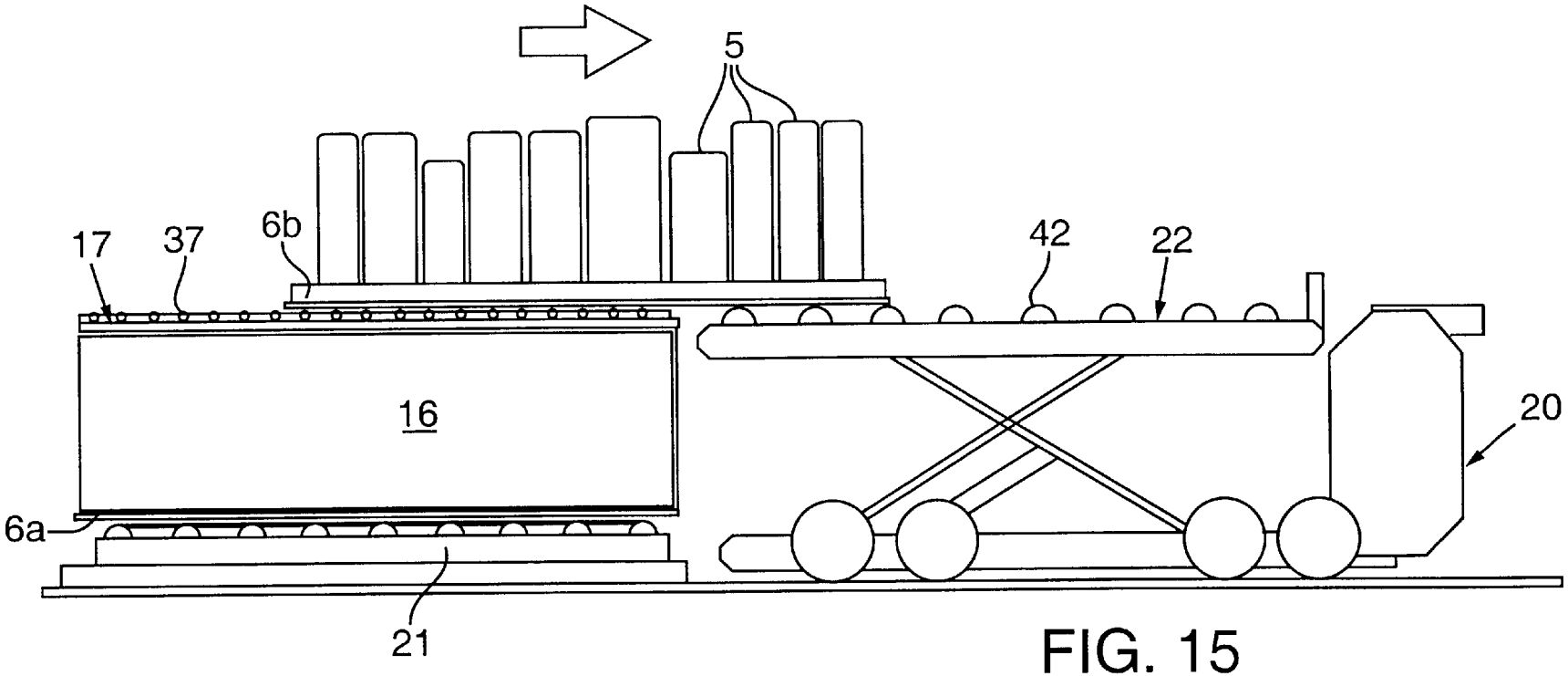
FIG. 15 illustrates the shifting of an upper transport pallet with its luggage onto the shifting tool provided for the distribution to the cabins in elevational view in direction XV—XV of FIG. 13.

When a two-tier pair of transport pallets, as described above, arrives on the deck K4–K8 containing operation sites, the upper second transport pallet 6*b* with its goods units 5 is first moved onto the powered separate conveyor device 20, as shown in FIG. 15. Next, the unloading of the goods units 5 on this second transport pallet 6*b* is carried out and the pallets are distributed to their operation sites 2, such as cabins. Next, the casing 16 is detached and stored at some area 12 for the purpose of operation in reverse direction. The pallets can be most easily stored in the storage space 12 next to the cloakroom, which is located next to vertical conveyor 1. Next, the lower first transport pallet will be shifted in a similar way onto the powered transport device 20 in order to facilitate the unloading of the riding goods units to operation sites 2 as described above.

It is clear that the transport of goods units in reverse direction from the operation sites, such as from cabins 2*a* to a collection site, such as passenger 4*c*, proceeds in reverse order, whereupon each deck containing operation sites, a casing 16 will be placed on top of the lower transport pallet 6*a* already containing goods units and on top of this another upper transport pallet 6*b* with goods units 5 is placed. On the decks containing operation sites, as well as in the collecting sire, the placement of goods units 5 onto the upper second transport pallet 6*b* can be carried out in two slightly differing ways. The first way is to place an empty transport pallet 6*b* on top of the casing 16 and, when it has been placed on top of the first already loaded transport pallet 6*a*, goods units, such as luggage, can be placed onto the second transport pallet 6*b*. The second alternative is that, before hoisting, the second transport pallet with its goods units 5 will be hoisted as a whole on top of the first transport pallet and casing. The unloading can also be carried out in two different ways, which are opposite to the procedures described above. Of course, different procedures can be adopted in different places within the same ship, for example, on decks containing operation sites, the loading and unloading of the goods units can be carried out by placing them onto the second transport pallet hoisted higher up, while in the passenger terminal, the transport pallet can be hoisted with its goods, because more equipment is easily available. On the cabin decks, it is possible to load and unload luggage onto and from the transport pallet placed on top of the casing 16, whereupon a separate hoisting conveyor device 20 is not needed, and it is possible to use only a horizontally moving separate conveyor device.

Figure 3:
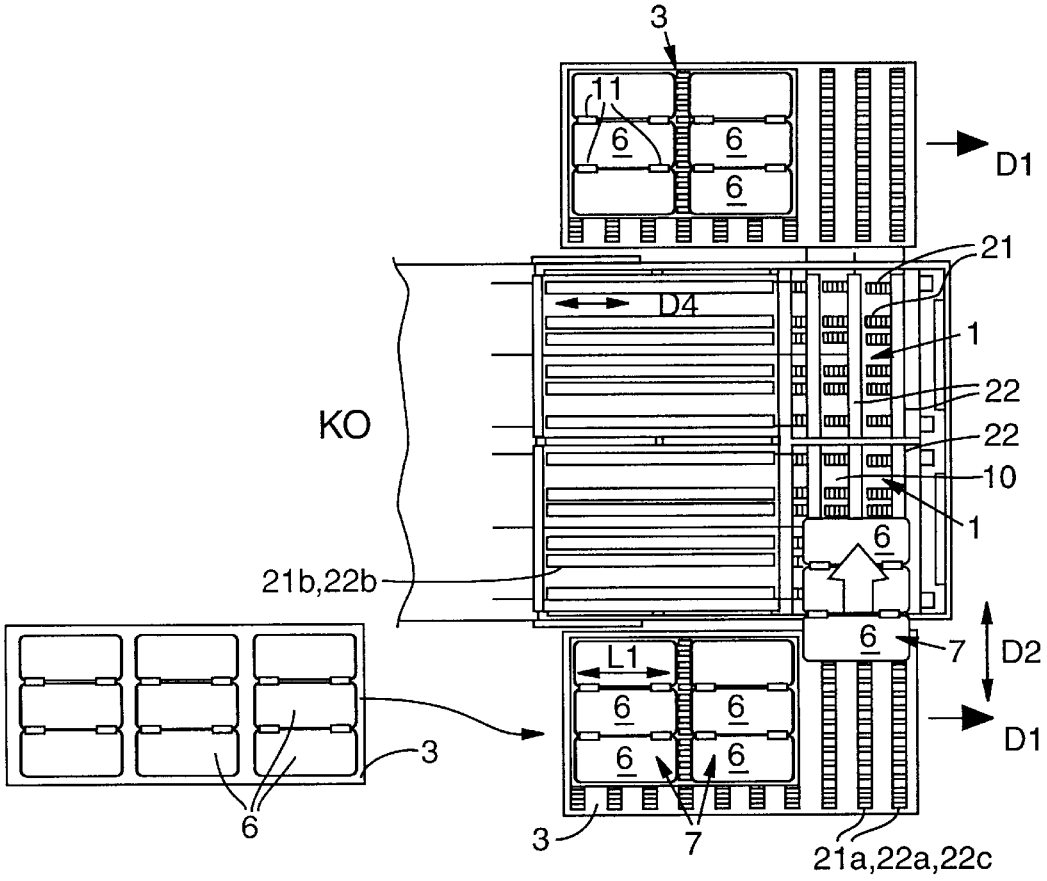
FIG. 3 illustrates, in top view as a section along plane III—III of FIG. 2, a procedure according to the invention, where goods units are brought in horizontal direction as bundles of pallets onto the lift platform according to the distribution method of the invention on the deck K0 containing a loading port.

As illustrated in FIGS. 1 and 3, the transport pallet, the bundles of pallets, and the transport platform are, according to the invention, are preferably formed and dimensioned in the following way. First, the transport pallets 6 are generally, but not necessarily, elongated so that their length L1 is in a first direction D1. In this case, the transport pallets are connected together one after the other as a tow in direction D2, where the second direction D2 is perpendicular to first direction D1. Second, the transport pallets are placed side by side onto the transport platform 3 in a line or lines in the third direction D3, which third direction again is perpendicular to the said second direction D2 and so runs parallel with the first direction D1. By this arrangement, the bundles of pallets are easily moved one by one in the collection site, such as the passenger terminal 4*c*, and between the ship's loading port 4*a* and the vertical conveyor 1, in the second direction D2, i.e., in the direction of the bundle of pallets onto the transport platform 3 and again respectively from the transport platform to the loan platform 10 of the vertical conveyor, as can be seen in FIGS. 1 and 3. Especially with respect to FIG. 3, it can be noted that when the first bundle of pallets 7 has been moved away in direction D2 from the transport platform 3, the transport platform will be moved in the said first direction D1 so that the second bundle of pallets comes up to the lifts, whereupon it will be pushed again in the second direction D2 onto the lift platform, and finally the transport platform 3 will be moved by one length measure L1 of the transport pallet until the third bundle of pallets 7 on the transport platform comes in line with the load platform of the vertical conveyor. Next, this third bundle of pallets 7 is pushed onto the load platform 10 in the second direction D2. After the bundle of pallets 7 has been brought to some of the ship's decks K0 to K8, it, in this case, can be pushed away from the load platform 10 of the vertical conveyor in a fourth direction D4, which is perpendicular to this second direction, as illustrated in FIGS. 1 and 3. In the embodiments of FIGS. 1 and 3, this fourth direction D4 is perpendicular to the second direction D2, but nothing prevents using such an embodiment where this fourth direction D4 is parallel with the second direction D2, whereupon, as distinct from the embodiment shown in FIGS. 1 and 3, only a conveyor working one direction is needed on the load platform of the vertical conveyor.

When the ship is calling a port and luggage is moved from the passenger terminal to the ship, a very large number of goods units 5 are received in the collection site 4*c* in a very short period of time. The distribution of these goods units to cabins 2*a* along the corridors 30 of the ship is a slower process. In this case, the congestion arising from this speed difference can be reduced by the following arrangement. According to the invention, also on ship's decks K0 to K3, other than cabin decks, corresponding storage spaces 8 can be arranged next to the vertical conveyor on decks K4 to K8 containing cabins. In this case, the movement of luggage by the vertical conveyor is according to the invention controlled so that, if on that ship's deck K4 to K8, where the said luggage 5 is intended to be brought, the luggage brought in the previous stage has bot yet been distributed to cabins, but there are still transport pallets in the storage space 8 of said deck, the transport pallets 6 or bundles of pallets 7 in question can be moved into the storage space 8 of these other decks K0–K3. When the storage space of the deck containing cabins is later freed (and at the same time, the vertical conveyor is also freed), which is obvious because the transporting times of the vertical conveyor as compared to other handling stages are short, the luggage from these temporary storage decks K0–K3 will be moved into storage spaces 8 of relevant cabin decks K4–K8 for further distribution. It is clear that, when the luggage 5 is transported in the opposite direction from the ship's cabins 2*a* to the passenger terminal 4*c* after ship's arrival at the port, the above described procedure is repeated in reverse order, provided that the pallets 6 or bundles of pallets 7 loaded with luggage have not moved with the transport platform at ship's loading port 4*a*, or to remove luggage from the pallets in passenger terminal 4*c*, a part of the pallets, loaded with luggage 5 belonging to cabin decks, will be stored temporarily in storage places 8 intended to other decks K0 to K3. From these temporary storage places, the pallets 6 or bundles of pallets 7 are removed immediately after there is room for them in subsequent stages of the transfer chain.

The structure and method of application of the transport platform can be seen in FIG. 3. The transport platform 3 is a supporting structure, which can be lifted by forklift trucks and the like. On the upper surfaces of the transport platform, there are either powered belt conveyors 21*a*, or powered roller conveyors 22*a*, or passive roller conveyors 22*c*, by mean of which the transport pallets 6 or bundles of pallets 7 can be moved out onto the load platform of the vertical conveyor in direction D2, as presented in FIG. 3. In case a passive roller conveyor 22*c* is used, which does not have a powered drive, the movement will take place in direction D2 by manual effort, or by inclining the edge of the transport platform away from the vertical conveyor 1. The shifting of the adjacent bundles of pallets 7 or separate pallets 6 in the subsequent stage onto the load platform 10 of the vertical conveyor occurs so that the transport platform with pallets on it will be moved in direction D1, as can be seen in FIG. 3, whereupon the following pallets and bundles of pallets end up at the load platform of the vertical conveyor and can thus be moved in a similar way onto it. It is clear that movements in the opposite direction from the load platform 10 of the vertical conveyor onto the transport platform 3 will take place by reverse measures.

Figure 2:
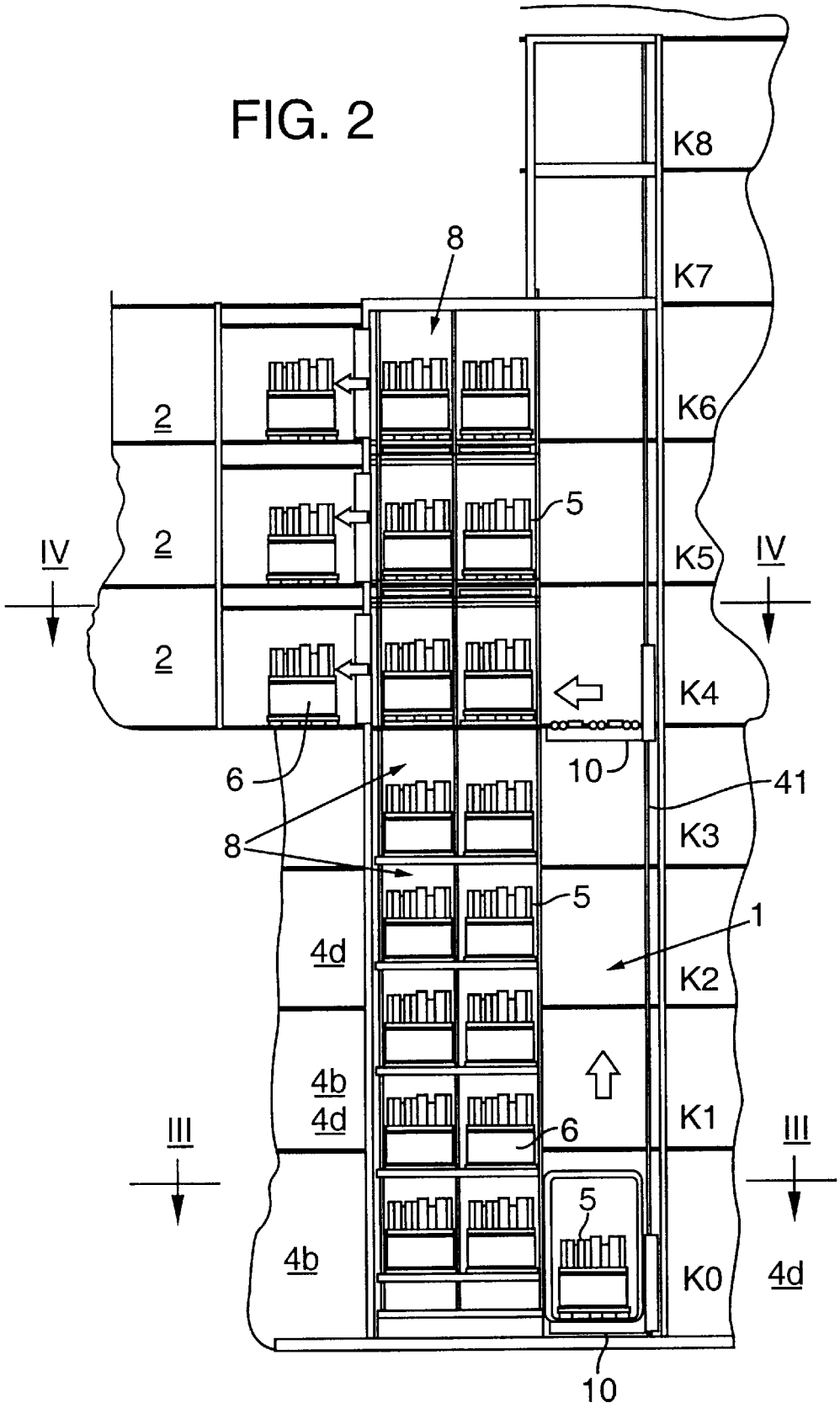
FIG. 2 illustrates in horizontal side view, the lift arrangement within the ship, which is used in the distribution methods according to the invention, containing the ship decks K4 to K8 of various operation sites, ship decks K0 to K2 of various collections sites, and another deck K3.
Figure 5:
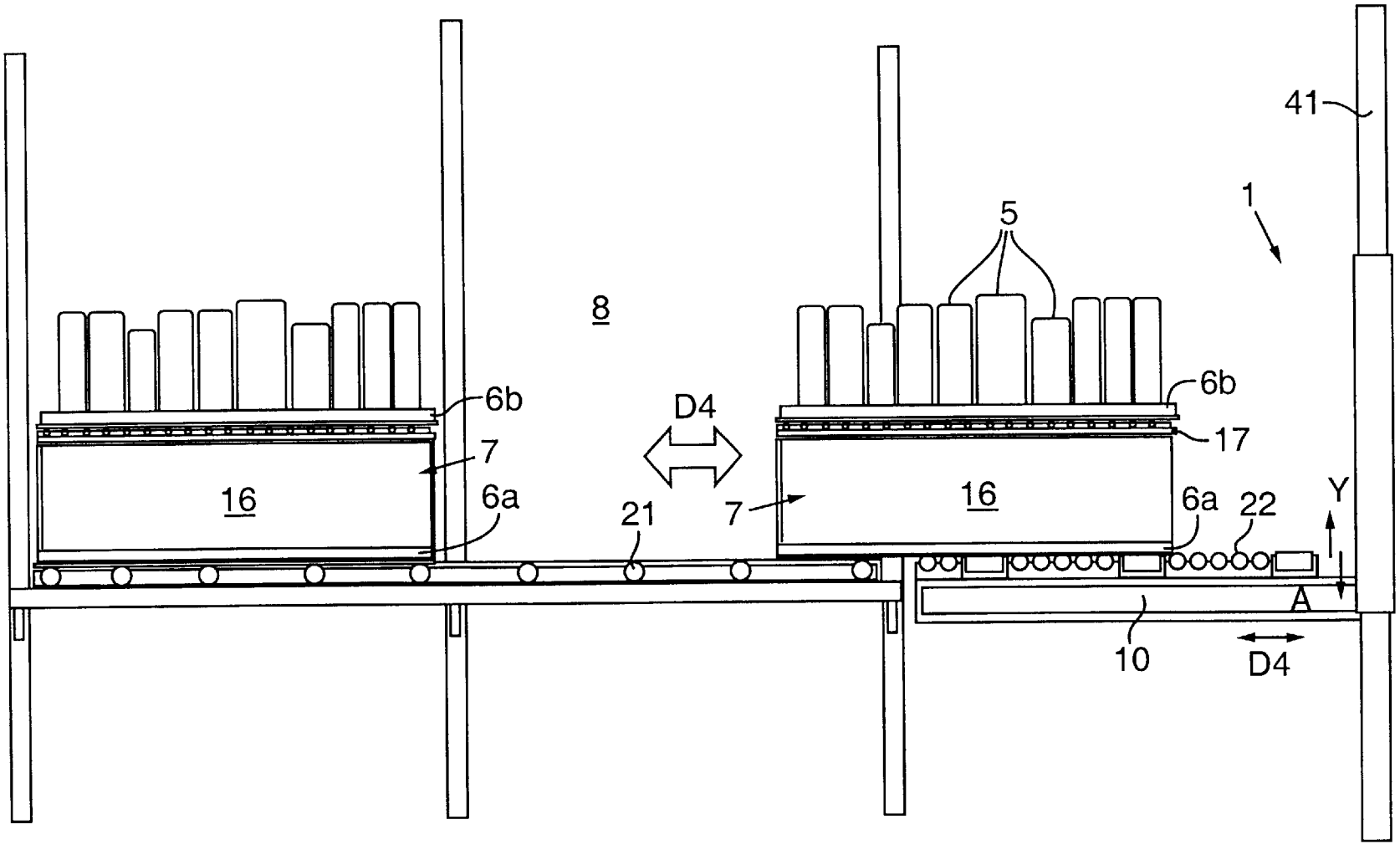
FIG. 5 illustrates a cross-section of the procedure in FIG. 4 in elevational view as a section along plane V—V of FIG. 4.
Figure 6:
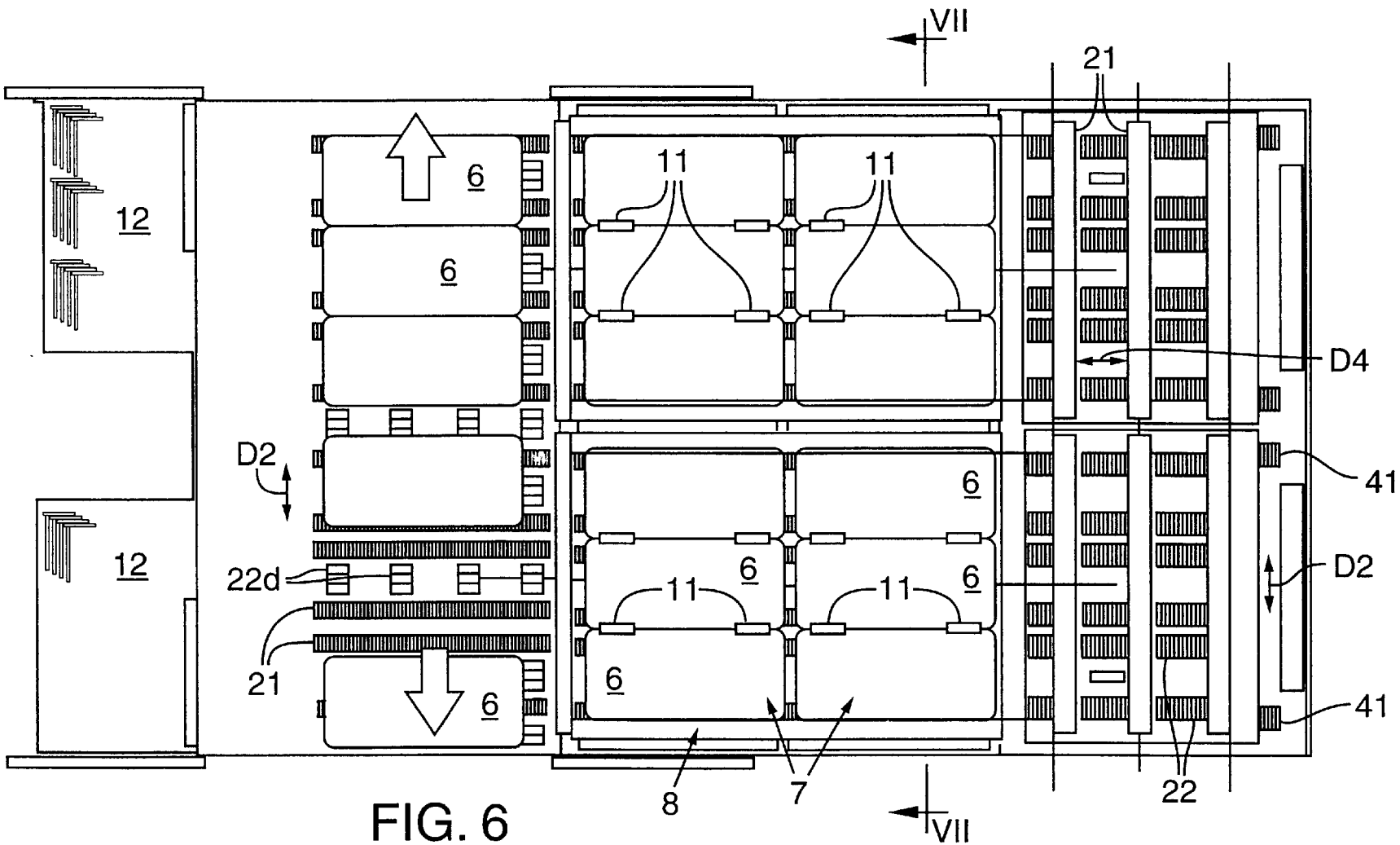
FIG. 6 illustrates one method according to the invention for removing goods units from the space adjacent to the lift, pallet by pallet, in top view in the same image as FIG. 4.

The vertical conveyor 1 as its most typical embodiment is a lift containing in its load platform a horizontal conveyor 21 and/or 22. In its most preferable embodiment, the lift is of a type where a flat load platform 10 without walls is connected to vertical guides 41. This kind of load platform can be loaded and unloaded via at least two sides. The structure of the lift is best shown in FIGS. 2, 5, and 6. According to the invention, the vertical conveyor arrangement comprises, as illustrated in the figures, two lifts 1 side by side, which can be used independently from each other. With this arrangement, it is possible to more effectively use the transportation system, which is otherwise easily a restrictive factor, when the ship is loading or unloading in the harbor. The load platform 10 of the lift contains, according to the preferable embodiment illustrated in the figures, two conveyors, with transportation directions perpendicular to each other. First, the load platforms contain a conveyor 21 operating in the second transportation direction D2, as in FIG. 6, or conveyor 22, as in FIG. 3. This second transportation direction D2 of the transport pallet D2 in FIG. 3. Thus, the conveyor of the lift's load platform continues the movement direction yielded by the transport platform, whereupon the pallets or bundles of pallets can be brought to place onto the load platform as shown by the lower lift in FIG. 4. The movement itself is shown in FIG. 3.

In addition to the above, the load platforms 10 of the vertical conveyor contain a conveyor 22 or 21 operating in the fourth direction D4. When the load platform of the vertical conveyor has been brought to the appropriate cabin deck K4 to K8, or other deck K0 to K3, this conveyor operating in the fourth transportation direction will move the pallets or bundles of pallets away from the load platform of the lift in this fourth direction D4 onto the deck in question, as illustrated in FIGS. 4 and 5. The change in operation on the load platform between these two conveyors 21 and 22 crossing each other is enabled by either hoisting the one or lowering the other in a direction perpendicular to the load platform. The bundles of pallets 7 in conveyor arrangement shown in FIGS. 4 and 5 can be moved from the load platform onto the decks K0 to K8 containing operation sites or equivalents, and vice versa, by hoisting the roller conveyor 22 in direction Y or by lowering the belt conveyor 21 in direction A and by starting a powered roller conveyor 22 at the same time. Respectively, the movements illustrated in FIG. 3 onto the load platform 3 and away from there, are produced by either hoisting the belt conveyors 21 of the load platform in direction Y or by lowering roller conveyors 22 in direction A and by starting the belt conveyors 21.

In order that the movement of transport pallets and bundles of pallets further on deck K could be possible, the decks containing operation sites 2 have conveyors operating in the fourth direction D4, as can be seen in FIGS. 3 to 5. These conveyors on decks containing operation sites can be belt conveyors 21 or equivalent powered roller conveyors. By this arrangement, the pallets or bundles of pallets are moved in a simple and effective way from the load platform 10 of the lift onto the deck in question.

In the arrangement described above, the transport pallets 6 are brought onto the load platform 10 on the deck K0 containing a collection site 4*a*/4*b* in one direction, and the pallets on the decks containing operation sites are removed in a second directions perpendicular to the first direction. However, nothing prevents realization of an arrangement where the removal from the load platforms on decks containing operation sites is effected in the same direction D2, in which the pallets are brought onto the deck containing collection sites. In this case, only a conveyor operating in one direction is needed on the load platform 10 of the vertical conveyor. Additionally, in this case, the conveyor on the deck containing operation sites is working in this one direction. This arrangement is not shown in the figures. It is clear that in all these alternative lines of action, the transportation from decks containing operation site onto the deck containing a collection site takes place in a way opposite to that described above. Typically, at least the conveyors operating on the decks containing operation sites from the bottom for the storage space 8.

Figure 13:
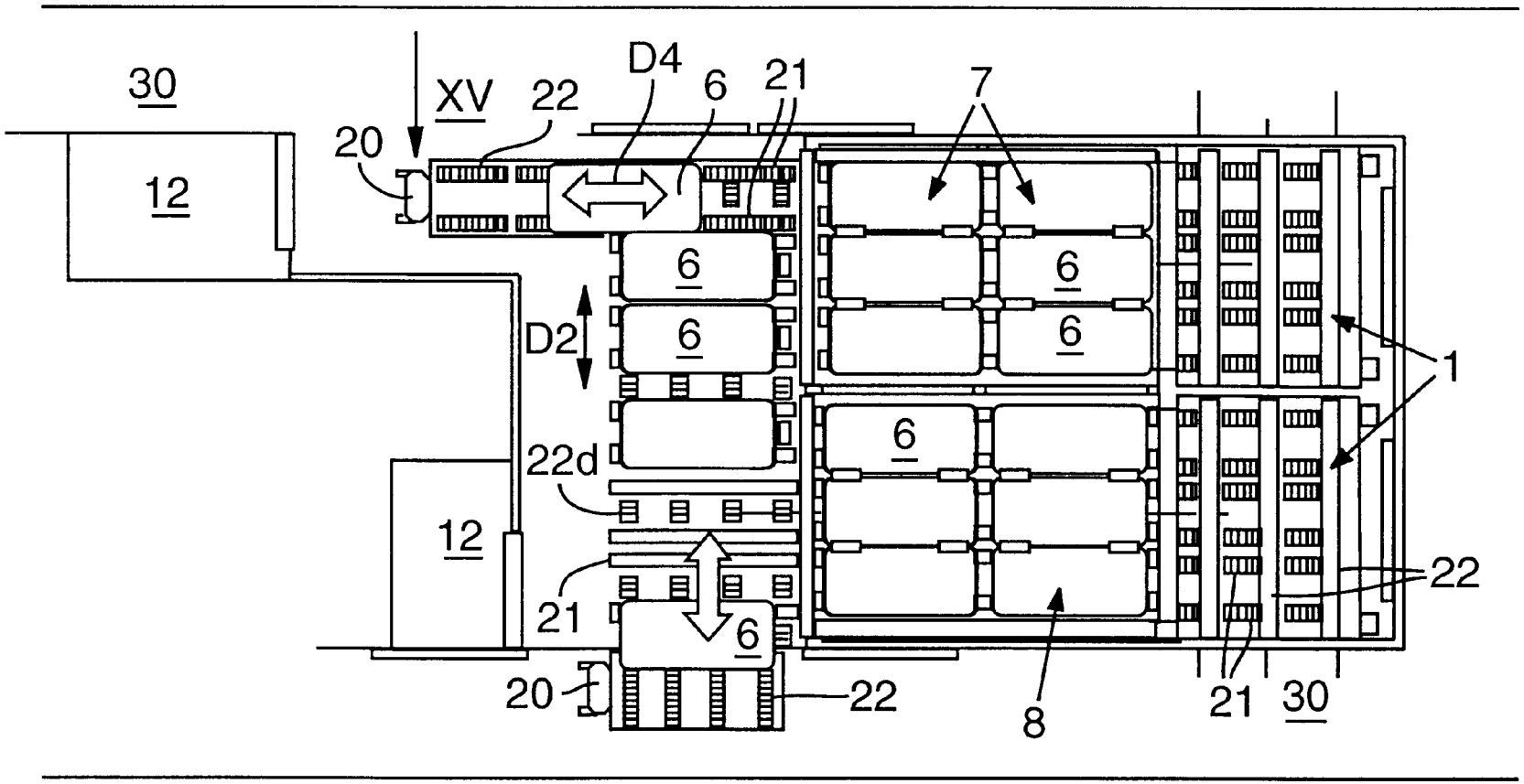
FIG. 13 illustrates two different ways to shift goods units with their transport pallets from the location adjacent to the lift onto the shifting tool provided for the distribution to the cabins, in top view in the same image as in FIGS. 4, 6, and 8.

Depending on the direction where the individual transport pallets 6 or pairs of pallets 6*a*/6*b* are removed from the storage space 8, the decks containing operation sites may also contain conveyors 22*d* operating in this second transportation direction D2, as shown in FIGS. 6 and 13. In this case, the transport pallets with luggage are moved by these conveyors 22*d* from the storage space to the corridor 30 on the deck K4 to K8 containing operation sites in order to be moved further by a separate transportation device 20. On decks other than K0 to K3 containing operation sites, there generally is no need for these conveyors 22*d*. It is also possible to move the transport pallets 6 away from the storage space 8 by moving them in fourth direction D4, which is the transportation direction of the storage space conveyors, as is shown in the arrangement described earlier in FIG. 13. Additionally, conveyors operating in the second direction D2 are needed in order to feed transport pallets from the edge of the storage space onto the separate transportation device 20. These conveyors operating in the second direction D2 can be omitted from the storage space, if space is arranged on the deck corridor 30 for the separate transportation device 20 so that it can take any one of the adjacent transportation pallets in the storage space without needing to move them. This embodiment is not shown in the figures. In such a case that the load platforms of the vertical conveyor only have conveyors operating in the said second direction, the transportation directions within the ship are simplified so that the conveyors on load platforms 10 and on various decks of the ship are all operating in the same said second direction. In this arrangement, formation of storage spaces and deck corridors diverges from that shown in the figures.

FIGS. 9–12 illustrate, in a larger scale, conveyors used in the arrangement according to the invention. The other conveyor 21 comprises belt strips running on rollers, and the roller conveyor 22, shown in FIG. 10, comprises transport rollers 25 and 26 arranged one after the other in a line. A part of the rollers (i.e., rollers 25) are passive, and a part of the rollers (i.e., rollers 26) are powered (e.g., directly by motors 27 coupled to their axles). When the conveyors are formed narrow and long, as is to be seen in top view in FIGS. 3, 4, and 6, the conveyors can be placed at intervals between each other whereupon it is simple to transport a platform in two directions, when the conveyors moving in different directions are arranged as described above, and are either hoisted or lowered. If need be, the roller conveyor can also be formed as a non-powered on, as the conveyor 22*c* of the transport platform 3 in FIG. 3, whereupon the movements of the transport pallets can be effected either by inclining the conveyor or by pushing the pallets manually. If desired, it is also possible to apply either of these procedures in other locations of the transfer chain.

Figure 18:
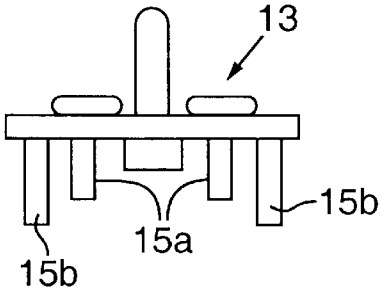
FIG. 18 illustrates, in a larger scale, the fastener clamping together the transport pallets according to the invention illustrated in FIG. 17.
Figure 16:
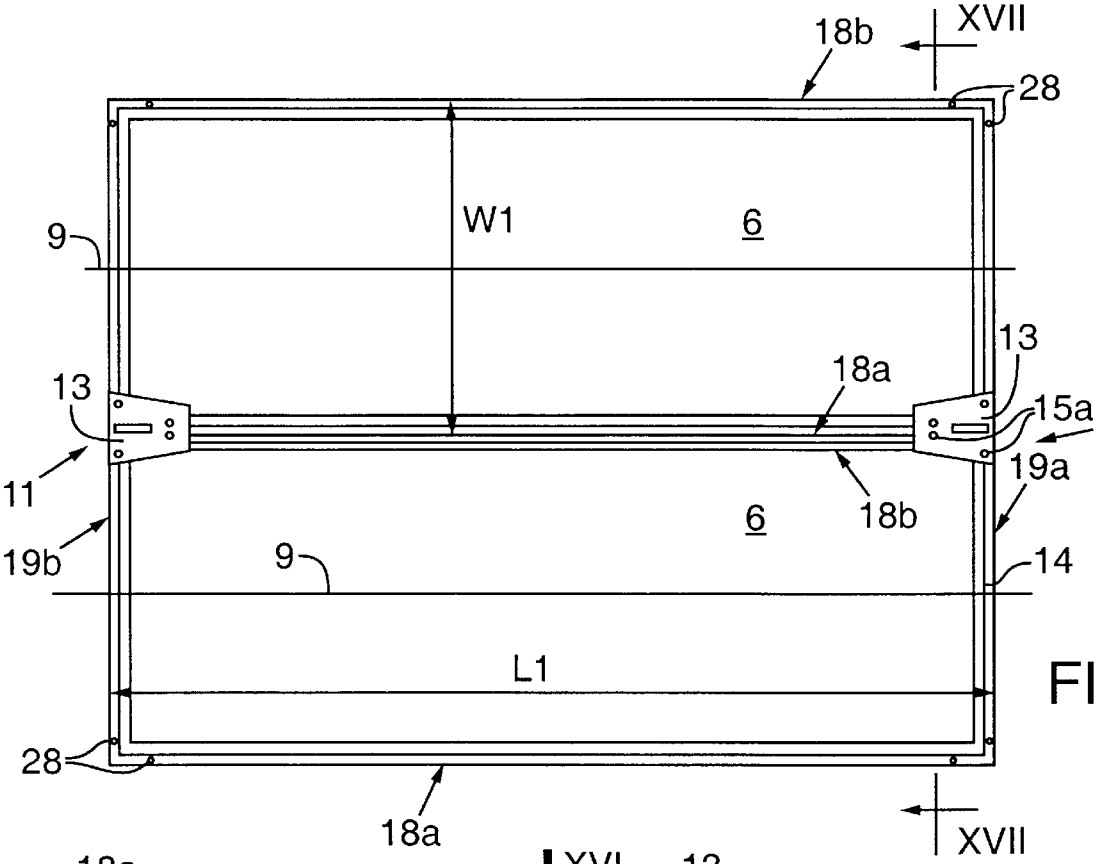
FIG. 16 illustrates two adjacent transport pallets according to the invention, clamped to each other in top view in direction XVI—XVI of FIG. 17.
Figure 17:
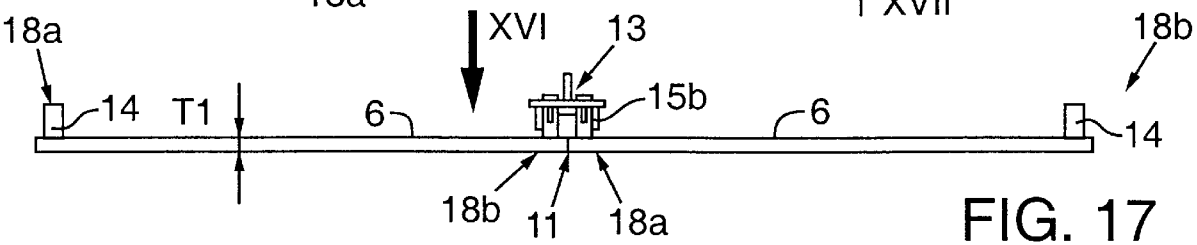
FIG. 17 illustrates the combination of transport pallets in FIG. 16 in vertical section as a section along plane XVII—XVII in FIG. 16.

In the distribution method according to the invention described above, it is advantageous to use a transport pallet 6 according to the invention. As illustrated by FIGS. 16–18, the transport pallets 6 are rectangular, mainly laminar structures having parallel opposite edges 18*a*, 18*b*, 19*a* and 19*b*. The thickness of the transport pallet T1 at the area where the goods units are supposed to be placed is small, measuring from 5 to 20 mm. Consequently, the pallets resemble air freight pallets and are not intended to be lifted with a fork-lift truck or other device by the brim or elsewhere, but are intended to be moved along belt conveyors or roller conveyors as described above. The transportation pallet can simply comprise as aluminum sheet, plywood board, other sheet material, or a think sandwich structure. According to the invention, this transport pallet contains at least two opposite junction edges 18*a* and 18*b*, fastening members 13 in order to clamp 11 them together with a similar adjacent transport pallet on the same plane, as shown in general in FIGS., 1, 4, 6, and 7, and in detail in FIGS. 16–18. The transport pallets 6 are symmetrical with respect to the centerline 9, running parallel with the junction edges 18*a* and 18*b*, containing fastening members 13, whereupon several transport pallets can be connected one after the other in line to bundles of pallets 7, as shown in FIGS. 1, 4, and 6. Advantageously, the transport pallets 6 are also symmetrical with respect to another centerline not shown in the figures, which is perpendicular to this said centerline 9, whereupon the transport pallet can face either direction so that it is attached by either junction edge 18*a*/18*b*, to either junction edge 18*a*/18*b* of the other pallet 6.

In order to reinforce the transport pallet, to simplify the junction 11, fastening members 13, and to keep the goods units 5 placed on the pallet fixed in their places, edge flanges 14 are advantageously provided to at least two opposite edges, which are said junction edges 18*a* and 18*b*, but more advantageously at all edges, 18*a*, 18*b*, 19*a* and 19*b*, and are provided perpendicular to the pallet's plane. As can be seen in FIGS. 16 and 17, the fastening members are formed in this edge flange 14, for example, by holes 28, near the pallet ends 19*a* and 19*b*, either at the end area or at the junction edge 18*a*/18*b* area, or at both areas as illustrated in FIG. 16. In this case, the transport pallets can be joined together by fastening members 13 containing dowels 15*a* at appropriate locations so that they can be inserted in the holes 28 at the edge flanges 14. The fastening members 13 reach up to the fastening holes 28 of the adjacent pallets and in this way, they bind the adjacent pallets to each other. Additionally, the fastening members 13 can contain downward-pointing flanges 15*b* to further stiffen and reinforce the structure. The fastening members 13 can be articulated, or in other ways, controllably joined to the pallets, in order to prevent them getting lost. It is clear that it is also possible to use other kinds of fastenings 11 between the transport pallets, provided that they are used to join adjacent pallets at the same plane or level in the described manner so that the pallets are kept together in the direction of their load platform. The joining in vertical direction is of little consequence because the bundles of pallets are moved on belt conveyors and roller conveyors horizontally or almost horizontally.

In addition to the embodiment described above, the pallet structure according to the invention comprises a casing 16 consisting of vertical supports 31, which, at their lower ends, rest on the edge parts 18*a*/18*b* and/or 19*a*/19*b* of the transport pallet 6. These supports consist of a framework, or advantageously of walls 31*a*/31*b*, of the transport pallet's opposite edges, as the fastening edges 18*a*/18*b*, run parallel to them. These walls 31*a* and 31*b* have been fixed by their upper edges to the upper part 17, which is mainly laminar structure nearly in line with the transport pallet.

Thus, the casing mainly forms a shell having a shape of the letter U turned upside down, whose lower edges 33 rest on the transport pallet 6 and typically on its edge flanges 14. Because of this need for support at the lower edges 33, downwards pointing grooves 34 have been shaped , whose edges have their place on both sides of the transport pallet's edge flange 14, as can be seen in FIG. 21.

This casing 16, shaped like an inverted U according to the invention, is divided according to the invention at the center plane 29 running parallel with the sides 31*a* and 31*b* into two parts, which so comprise almost L-shaped coverparts 16*a* and 16*b*. These two coverparts 16*a* and 16*b* are connected to each other by a dovetail joint 32 on the upper part 17, thus comprising dovetail-shaped grooves, and into these are inserted separate joining members of the upper part 17. These joining members are dowel like objects, wider at their edges, which match the shape of the dovetail groove. Other kinds of joining members can of course be used. In this way, the casing 16 can, if needed, be divided in two L-shaped coverparts 16*a* and 16*b* which can easily be stored in storage spaces 12 (e.g., next to each cloakroom 8) as shown in FIGS. 4 and 6. The shape described here is particularly advantageous because of the fact that storage in a very small space is possible since the leg thickness T3 and T4 of the L-shaped coverparts are small, generally under 50 mm. When the casing 16 is needed for the transport pallet 6, it is easy to take the coverparts 16*a* and 16*b* from the storage space 12, join them together by dovetail joints 32 and then place onto the pallet 6. Next, a second pallet 6*b* can be placed on top of this casing 16 and goods units 5 on the latter. If need be, it is possible to place another casing 16 on top of the upper transport pallet 6*b* (e.g., in order to protect the luggage). Depending on the conveyor arrangements and lifting arrangements within the ship and in the terminal, as well as the need to save floor space, a third transport pallet can be placed on top of the upper casing 16, which is not shown in the figure, and on this then place the luggage. This stacking of the pallets and casings is limited only by the vertical height and devices available for their handling.

If the goods units 5 are placed on an upper transport pallet 6*b*, and the goods units are removed from it while this transport pallet is kept on the upper part 17 of the casing 16 resting all the time on the lower pallet 6*a*, there is no need to shift the casings. This kind of loading and unloading of luggage and goods units from the upper transport pallet and onto the upper transport pallet allows movement of the pair of pallets, which is formed of the lower and upper transport pallet, along the ship's corridors 30 by means of a separate conveyor device 320 and lifting of individual goods units, like luggage, onto the upper pallet 6*b* (e.g., onto the upper pallet in FIG. 21). If it is desirable to transport pallets with good units only one by one by means of this conveyor device 20, this feature can be furnished by a hoisting device, which is not necessary in the procedure described above. This kind of separate conveyor device 20 is illustrated in FIG. 15, when the upper transport pallet 6*b* is moved away from the lower transport pallet 6*a* and casing 16, or on top of the casing 16, respectively.

Figure 19:
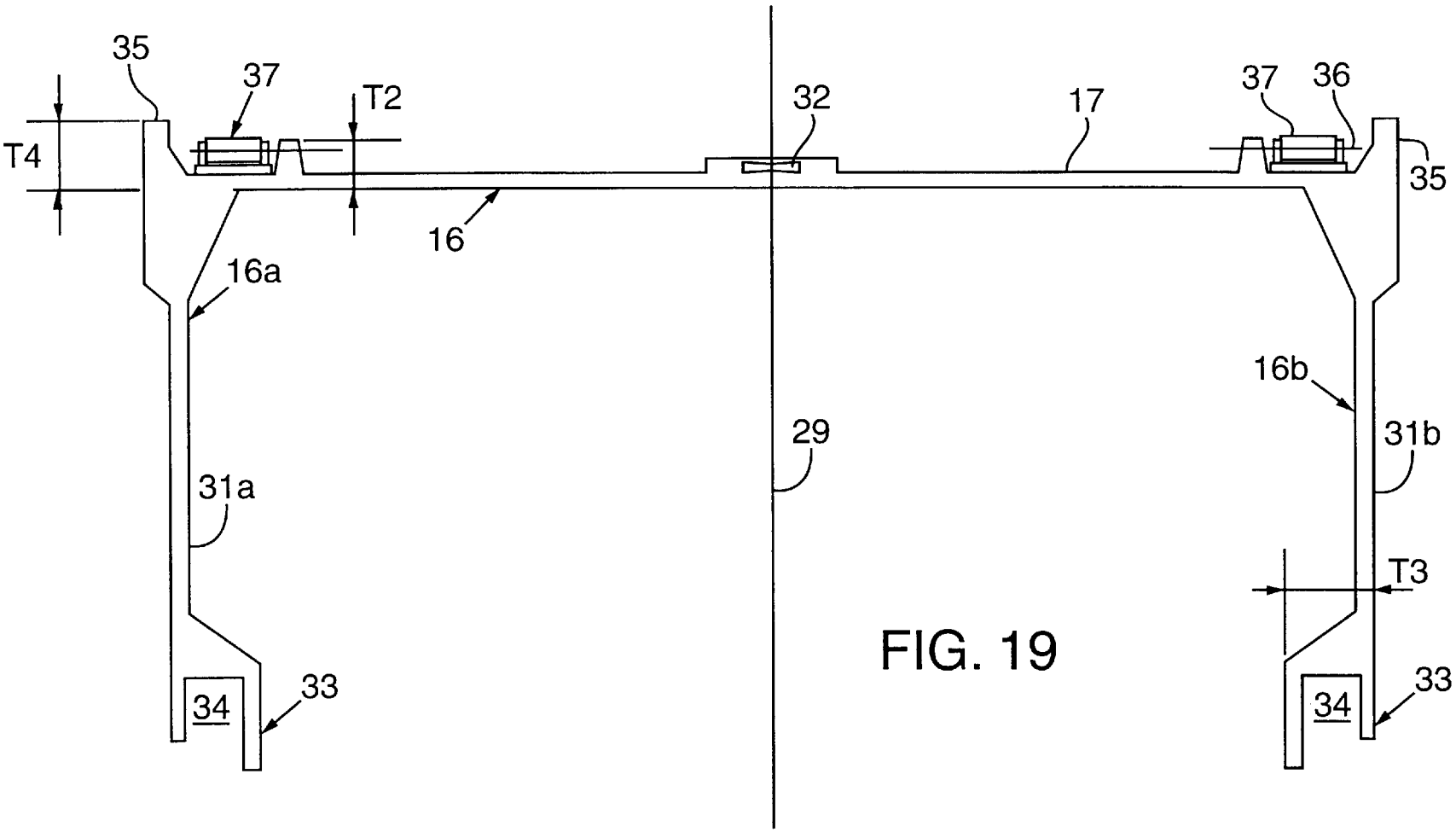
FIG. 19 illustrates a vertical cross-section of the housing for the transport pallet according to the invention illustrated in FIG. 17.
Figure 20:
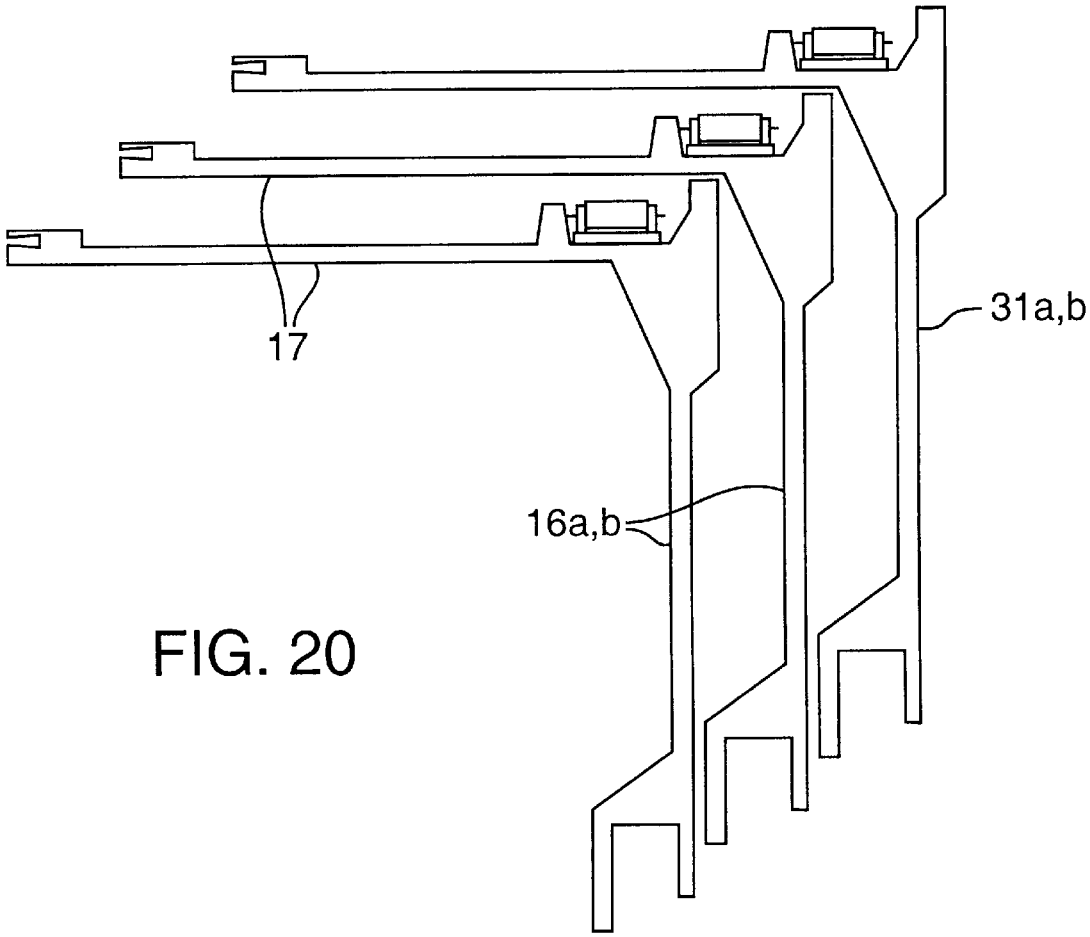
FIG. 20 illustrates halves of the transport pallet housing as separated from each other and arranged for storage.
Figure 22:
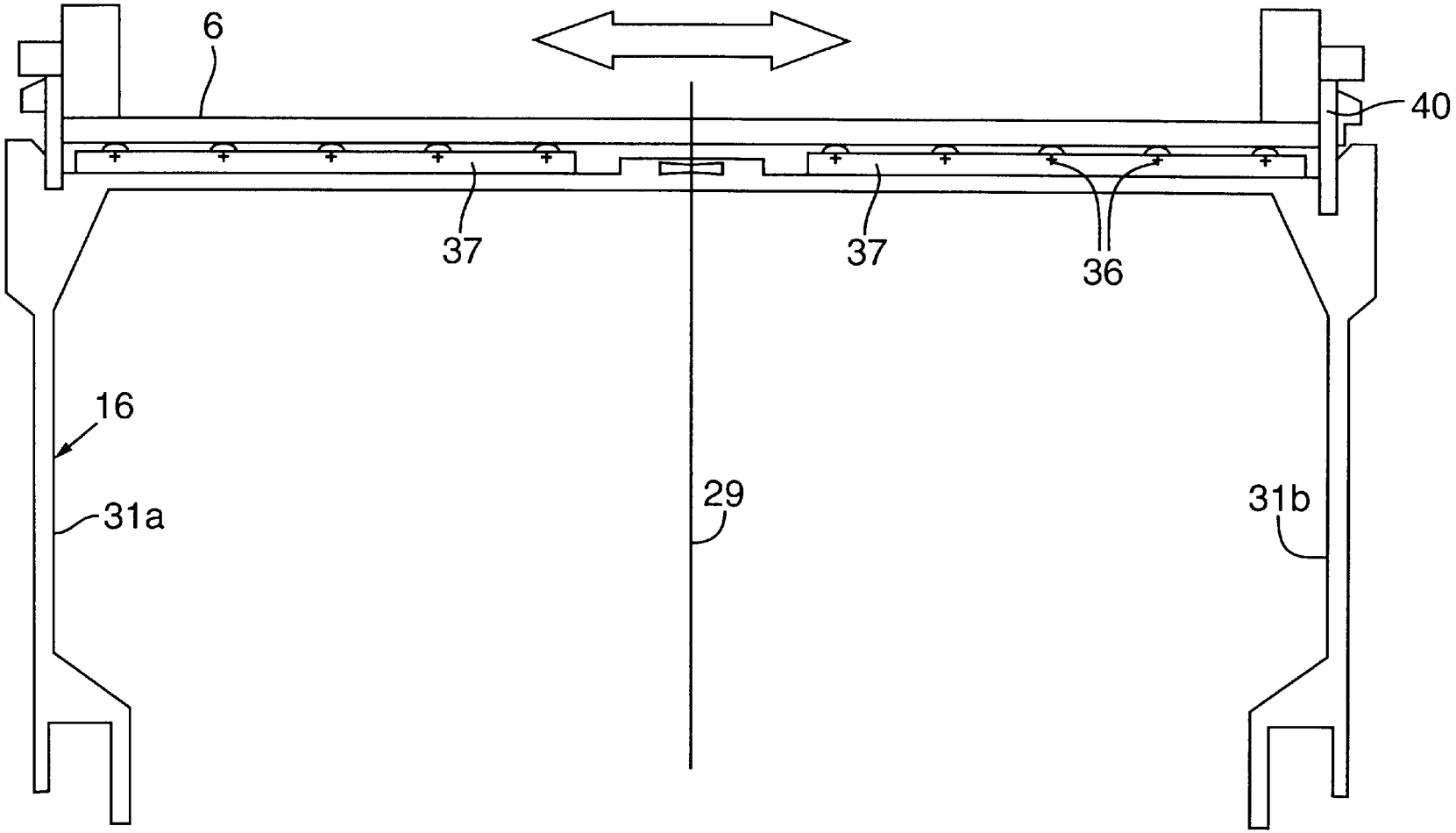
FIG. 22 illustrates a transport pallet housing of another type according to the invention as a vertical cross-section as illustrated in FIG. 19.

In order to be able to shift the transport pallet 6*b* with the luggage from and onto the transport pallet 6*a* and casing 16, the upper part 17 of the casing must be furnished with a roller conveyor 37, along which the upper transport pallet 6*b* can slide. In this roller conveyor 37, the roll axle lines 36 are either running parallel with the said walls 31*a*, 31*b* or advantageously perpendicular to them. In FIG. 19 the latter advantageous (in terms of physical properties) embodiment is described, since the rolls are near to the walls 31*a*, 31*b* whereupon the force of the upper pallet 6*b* is acting almost as a compressive force on said walls. In FIG. 22, another embodiment is shown, where the roller conveyor axles 37 are parallel with the walls. In this embodiment, the load is distributed over the whole width of the casing.

In addition to the above described embodiment, on the upper part 17 of the casing 16 there are at least two extensions protruding upward 35, which are perpendicular to the roller axle lines 36 of the roller conveyors 37, as shown in FIGS. 19 and 21. These extensions 35 prevent the pallet, placed on the roller 37, from moving away from the casing in a direction perpendicular to them. In the other direction (i.e. in the direction of their operation), the upper transport pallet 6*b* is prevented from moving out of place by the stoppers 40, one embodiment of which is shown in FIG. 22. It is clear that it is possible to form a great variety of different stoppers wand the invention is not limited only to the illustrated stopper. In case that it is intended to load goods units onto and from a raised transport pallet 6*b*, when it is placed onto the upper part 17 of the casing 16, it is advantageous to arrange extensions 35 protruding from the upper part on each side of the casing, in order to keep the upper pallet in place. In this case, the use of the upper pallet can be omitted and goods units 5 can be loaded directly onto the upper part 17 of the casing 16. In a similar way, the good units can be placed directly onto the second, and possibly onto the third, upper part 17 of the casings piled on top of each other.

The separate conveyor device 20 shown in FIG. 15 is advantageously of an articulated jack type, in light of the low gross weight of the present pallets of a quite light construction. The conveyor device in this case comprises a shifting platform 42 furnished with a conveyor 22, a power device, and rollers 43, by means of which the conveyor device 20 moves and is controlled along the corridor 30 of the ship's deck K. The light design makes it possible for the height of the conveyor device 20 with lowered shifting platform 42 to be only about 100 mm, whereupon the lower transport pallets 6*a* can, without special arrangements, be pushed onto their shifting platforms 42. This conveyor device is also easy to load with an upper transport pallet 6*b* when the shifting platform is in a hoisted position. Provided that the goods units are placed onto the upper transport pallet 6*b* only after the pallet has been put in place, and the goods units are taken away from it when it is on the lower transport pallet, there is not need to have any kind of lifting mechanism in the conveyor device 20. A shifting platform equipped with a conveyor 22 or 21, whose height from the deck is from 50 to 100 mm, which is sufficient.

Another possibility is not to use a separate conveyor device 20, but instead allow the passengers to take their luggage 5 from the cloakroom 8 next to the vertical conveyor 1 or near it from the transport pallet 6. The casing 16, transport pallets 6, and possibly transport platforms 3 coming with them (e.g., in the solution according to FIG. 8), can be stored during the voyage in storage space 12 next to the cloakroom, in a conventional storage space somewhere else, in the cloakroom against the wall in vertical position, or recessed in the floors between the ship's deck K0 to K8 (as shown in FIG. 7).

What is claimed is:

1. A distribution method for transporting goods on ships having at least one operation site onboard a ship and at least one collection site, the method comprising the steps of:

providing at least first and second transport pallets near the collection site, the first and second transport pallets being connected together to form a bundle of pallets;

providing a first vertical conveyor;

placing the goods on the first and second transport pallets;

moving the first and second transport pallets, including the goods, by the vertical conveyor, to the operation site;

unloading the goods from the first and second transport pallets; and moving the goods to the operation site.

2. The method of claim 1 further including performing the steps in the reverse order.

3. The method of claim 1 in which the goods are one of luggage units, linen, and food stuff.

4. The method of claim 1 in which the goods are luggage units having sides and the first transport pallet has a surface area that accommodates between 5 and 20 luggage units placed side by side.

5. The method of claim 1 in which the first and second transport pallets have brims and further including the step of:

connecting the first transport pallet and the second transport pallet together by the brims to form the bundle of pallets.

6. The method of claim 5 in which the bundle is formed with between three and five transport pallets.

7. The method of claim 1 in which there are a plurality of pallets, each pallet having sides, and further comprising the steps of:

placing the pallets side by side onto a transport platform that accommodates between three and five pallets;

positioning the pallets and platform on a quay;

moving the pallets on the transport platform from the quay to a location near the vertical conveyor;

separating the pallets from one another; and moving the pallets individually from the platform onto the vertical conveyor for moving the pallets to decks on the ship.

8. The method of claim 1 in which the operation sites are located on various decks of the ship, which decks have a cloakroom near the vertical conveyor, the vertical conveyor having a surface area at least large enough to accommodate the bundle of pallets and further comprising the step of moving the bundle of pallets to the cloakroom before unloading the goods.

9. The method of claim 1 further comprising the steps of:

storing the first pallet in a location near the collection site;

removing the first pallet from the location;

placing the goods on the first pallet;

providing a conveying means; and conveying the goods onto the vertical conveyor by means of the conveying means.

10. The method of claim 1 further comprising the steps of:

providing a deck near the operation site;

providing a horizontal conveyor on the deck; and conveying the goods by the horizontal conveyor from the vertical conveyor to the operation site.

11. The method of claim 1 further comprising the steps of:

providing a casing for containing the goods on the first transport pallet, the casing having an upper part;

placing an additional transport pallet on the upper part; and placing at least some of the goods on the additional transport pallet.

12. The method of claim 1 further comprising the steps of:

providing a plurality of transport pallets, each pallet having an elongated side extending in a first direction and a transverse side extending in a second direction; and arranging the pallets so that the elongated sides on some of the pallets are adjacent one another and the transverse sides of some of the pallets are adjacent one another and the arranged pallets form the bundle of pallets.

13. The method of claim 12 further comprising the steps of:

moving the bundle of pallets onto a transport platform;

moving the bundle away from the transport platform in the second direction;

moving the bundle onto the vertical conveyor; and conveying the bundle in one of the second direction and a direction perpendicular to the second direction.

14. The method of claim 1 in which a first plurality of operation sites are located on a first deck and in which during the placing step, only goods corresponding to the first plurality of operation sites are placed onto the first transport pallet.

15. The method of claim 1 further comprising the steps of:

marking each good with an individual goods identifier that indicates a particular operation site to which the good is to be moved;

providing a plurality of pallets;

providing a plurality of decks on the ship, at least some of the decks having operation sites;

marking each pallet with a pallet identifier to identify a particular deck to which the pallet is to be moved;

moving the pallets according to the pallet identifiers by the vertical conveyor; and moving each good to the said particular operation site according to the individual goods identifier.

16. The method of claim 1 wherein said bundle of pallets comprises at least two substantially rectangular, substantially planar structures, each structure having two sets of parallel opposite edges, at least one of the edges on each structure being a connecting edge, the connecting edge on one of the structures being adjacent the connecting edge on the other of the structures; and at least one fastening member connecting the connecting edge of the said one of the structures with the said other of the structures.

17. The method of claim 16 wherein said bundle of pallets has a perimeter, and at least one of the edges other than the connecting edge of the structures has a flange extending therefrom and the flange extends at least partially around the perimeter of the bundle of pallets for preventing the goods from coming off the bundle of pallets.

18. The method of claim 17 further comprising a casing for covering goods positioned on said structure, the casing having a bottom edge, and the bottom edge having at least one groove for receiving the flange.

19. The method of claim 16 in which the fastening member defines at least two connecting holes and each structure defines at least one connecting opening near the connecting edge, one of the connecting holes in the fastening member aligning with the connecting opening in one of the structures and forming a first aligned opening set, the other of the connecting holes aligning with the connecting opening in the other of the structures and forming a second aligned opening set, the bundle of pallets further comprising at least a first connecting pin and a second connecting pin, the first pin extending through the first aligned opening set and the second pin extending through the second aligned opening set to connect the structures together.

20. The method of claim 16 in which each structure has a periphery and further comprising a casing resting on the structure near the periphery of the structure, the casing including:

two inverted, substantially "L"-shaped coverparts; and and connector means connecting the two coverparts such that the coverparts and connector means form a substantially "U"-shaped casing.

21. The method of claim 16 further comprising:

a casing for covering goods positioned upon said structures, the casing having side walls and an upper part, the side walls extending between the structures and the upper part, the upper part capable of supporting a second pallet structure for storing extra goods and having an extension protruding upwardly from the upper part to keep the second pallet structure and extra goods from falling off the upper part;

at least one roller conveyor mounted to the upper part, the roller conveyor having rollers for rolling in a first direction;

and a stopper removably mounted on the upper part to prevent the second pallet from rolling off the upper part in the first direction.

22. The method of claim 1 wherein said first vertical conveyor at least partially extends between vertically spaced decks and the collection site, the first vertical conveyor having a load platform, providing on said load platform a first horizontal conveyor operable to horizontally convey the goods to one of on and off the first vertical conveyor; and providing a second horizontal conveyor on at least some of the vertically spaced decks having operation sites, and operating the horizontal conveyors to convey the goods from the first vertical conveyor to one of the operation sites.

23. The method of claim 22 comprising providing a second vertical conveyor adjacent the first vertical conveyor and extending between the same locations as the first vertical conveyor, and conveying goods on said second vertical conveyor between said locations.

24. The method of claim 22 in which the first vertical conveyor is a lift.

* * * * *